US007390959B2

(12) United States Patent
Masuda

(10) Patent No.: US 7,390,959 B2
(45) Date of Patent: Jun. 24, 2008

(54) TONE CONTROL DEVICE AND PROGRAM FOR ELECTRONIC WIND INSTRUMENT

(75) Inventor: Hideyuki Masuda, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/493,251

(22) Filed: Jul. 25, 2006

(65) Prior Publication Data

US 2007/0017352 A1 Jan. 25, 2007

(30) Foreign Application Priority Data

Jul. 25, 2005 (JP) ..... 2005-213775

(51) Int. Cl.
*G10H 3/00* (2006.01)
*G10H 1/02* (2006.01)
*G10H 5/00* (2006.01)

(52) U.S. Cl. ..... 84/723; 84/662

(58) Field of Classification Search ..... 84/744, 84/626, 662, 737, 723
See application file for complete search history.

(56) References Cited

U.S. PATENT DOCUMENTS 5,140,888 A * 8/1992 Ito ..... 84/723
5,149,904 A * 9/1992 Kamiya et al. ..... 84/723
5,170,003 A * 12/1992 Kawashima ..... 84/619
5,245,130 A 9/1993 Wheaton
5,459,280 A * 10/1995 Masuda et al. ..... 84/622
5,521,328 A 5/1996 Kakishita (Continued)

FOREIGN PATENT DOCUMENTS

GB 2221078 A 1/1990

(Continued)

OTHER PUBLICATIONS

Yoshikawa, Shigeru, Study on Organ Pipe and Its Underwater Application, Tokyo Institute of Technology, 1985, Japan.

(Continued)

*Primary Examiner*—Jeffrey Donels
(74) *Attorney, Agent, or Firm*—Morrison & Foerster LLP

(57) ABSTRACT

A tone control device applied to an electronic wind instrument realizes an octave-changeover-blowing technique in which the same note is produced with different octaves respectively by use of the same fingering state, thus increasing controllable ranges with regard to the tone volume, tone color, and tone pitch. A plurality of flow sensors are arranged in proximity to an edge with which a jet flow caused by blowing air into a blow hole of a lip plate collides within a tube of a wind instrument controller simulating an air-reed instrument. The flow sensors are horizontally arranged to detect a jet width, thus controlling the tone volume; and the flow sensors are vertically arranged to detect a jet eccentricity or a jet thickness, thus controlling the tone color. Ascending or descending of the tone pitch by octaves is controlled by use of the flow sensor and a jet length sensor.

8 Claims, 24 Drawing Sheets

U.S. PATENT DOCUMENTS

| | | | | |
|---|---|---|---|---|
| 5,543,580 | A | 8/1996 | Masuda | |
| 7,049,503 | B2 * | 5/2006 | Onozawa et al. | 84/723 |
| 2005/0217464 | A1 * | 10/2005 | Onozawa et al. | 84/723 |
| 2007/0017346 | A1 * | 1/2007 | Masuda | 84/600 |
| 2007/0068372 | A1 * | 3/2007 | Masuda et al. | 84/723 |

FOREIGN PATENT DOCUMENTS

| | | | |
|---|---|---|---|
| JP | 64-077091 | | 3/1989 |
| JP | 05-216475 | | 8/1993 |
| JP | 06-067675 | | 3/1994 |
| JP | 07-199919 | | 8/1995 |
| JP | 2002-049369 | | 2/2002 |
| SU | 690543 | A1 | 10/1979 |
| SU | 2239548 | A1 | 10/1979 |

OTHER PUBLICATIONS

Arimoto, Keita, Experimental Study on Jet Flow Distribution and Sound Characteristics in Air-Reed Instrument, Kyushu Art and Technology College, 2002.

Keisuke Chida et al., "Development of a New Anthropomorphic Flutist Robot WF-4," Proc. of the International Conference on Robotics & Automation, pp. 152-157, 2004.

Yasuji Sawada et al., "On the Transition Between the Sounding Modes of a Flute," The Journal of the Acoustical Society of America, May 1980, vol. 67, No. 5, pp. 1790-1794.

* cited by examiner

FIG. 29A
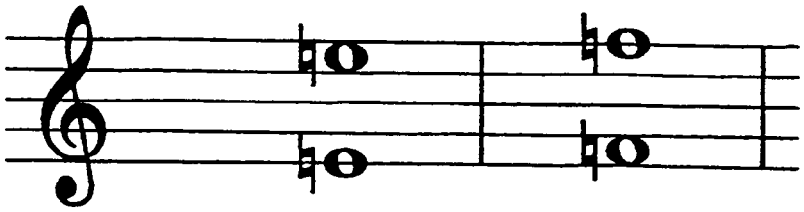
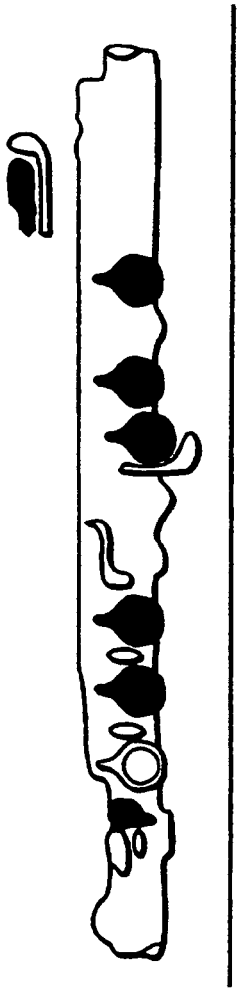
FIG. 29B
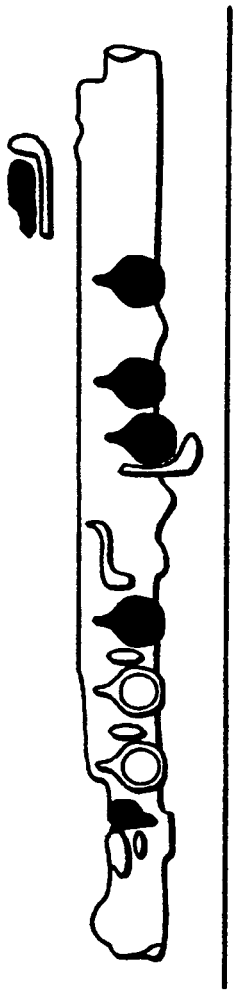
FIG. 29C

TONE CONTROL DEVICE AND PROGRAM FOR ELECTRONIC WIND INSTRUMENT

BACKGROUND OF THE INVENTION

1. Field of the Invention

This invention relates to tone control devices and programs for electronic wind instruments.

This application claims priority on Japanese Patent Application No. 2005-213775, the content of which is incorporated herein by reference.

2. Description of the Related Art

In general, octave-changeover-blowing techniques are applied to air-reed instruments such as flutes and piccolos so as to produce two notes, both of which have the same tone but differ from each other in pitch with an octave therebetween, by fingering. FIG. 29B shows a fingering state for producing notes E (see a left-side bar in FIG. 29A) with first and second octaves; and FIG. 29C shows a fingering state for producing notes F (see a right-side bar in FIG. 29A) with first and second octaves. For example, a player blows a wind instrument by way of the fingering state of FIG. 29B as follows:

In order to produce a note E of the first octave, the player blows the wind instrument with a relatively weak breath. In order to produce a note E of the second octave the player blows the wind instrument with a relatively strong breath. Herein, the first and second octaves slightly differ from each other in terms of embouchure.

Various physical parameters regarding sound emission have been analyzed with respect to air-reed instruments such as organ pipes (see a doctoral thesis entitled "Study on Organ Pipe and Its Underwater Application" written by Shigeru Yoshikawa in 1985 for Tokyo Institute of Technology in Japan). FIG. 30 shows physical parameters regarding a sound-emission structure of an organ pipe. In the sound-emission structure, AF designates an air flow applied to an organ pipe; SL designates a slit; and EG designates an edge. As physical parameters, there are provided a jet initial velocity U(0) [m/s] at an outlet of the slit SL, a jet final velocity U(d) [m/s] at the edge EG, a slit-edge distance d [m], a jet transmission time τe [sec] between the slit SL and the edge EG, and an audio frequency fso [Hz]. FIG. 30 also shows a relationship (i.e., a jet flow distribution) between a distance x counted from the slit SL and a jet velocity U(x). As shown in FIG. 30, the jet velocity U(x) gradually decreases from the initial velocity (0) to the final velocity U(d).

The aforementioned doctoral thesis teaches that octaves of sounds produced by air-reed instruments such as flutes and organ pipes depend upon a present sound mode and a jet angle θe. The jet angle θe is calculated using the jet transmission time τe and the audio frequency fso (or an audio angular frequency ωso=2π·fso) in accordance with equation 1 as follows:

$$\theta e = \omega so \times \tau e \text{ (where } \omega so = 2\pi \cdot fso)$$

In addition, the jet transmission time τe is calculated using the slit-edge distance d and the jet velocity U(x) in accordance with equation 2 as follows:

$$\tau e = \int_0^d 1/U(x)\,dx$$

The jet transmission time τe can be calculated using trapezoidal approximation instead of the aforementioned integral calculation. Suppose that Ui represents jet velocity [m/s] at a designated distance counted from the slit SL, i.e., x=i·Δx [m] (where i=1, 2, . . . , n), whereby the jet transmission time τe can be calculated in accordance with equation 3 as follows:

$$\tau e = \sum_{i=1}^{n} (1/2)(1/U_{i-1} + 1/U_i)\Delta x$$

The jet transmission time τe calculated by the equation 3 designates a hatching area Sd of a graph shown in FIG. 31. In order to improve the accuracy of the aforementioned calculation, it is preferable that Δx be sufficiently reduced to a value such as 0.1 [cm], and the jet velocity be detected at various positions respectively.

FIG. 32 show variations of octaves based on tone-generation modes and jet angles θe. FIG. 32 shows two tone-generation modes, i.e., a first mode and a second mode. In the first mode, a prescribed note is produced with a prescribed octave. In the second mode, the note, which is produced in the first mode, is produced with a one-octave-higher interval.

In FIG. 32, when a jet occurs at an initial velocity U(0) in a state $S_1$, a first mode tone generation is started in a state $S_2$ in which θe=3π/2. In a state $S_3$ in which the jet angle θe gradually decreases in an order of π, 3π/4, . . . , and π/2, an audio frequency gradually increases so as to cause variations on the tone volume and tone color in an actual air-reed instrument, which is not specifically discussed in the aforementioned doctoral thesis. In a state $S_4$ in which θe=π/2, a jump occurs from the first mode to the second mode, in other words, a one-octave-increase occurs. During a state $S_5$ causing a jump, the audio frequency is doubled so that the jet angle θe is correspondingly doubled to suit π.

In a state $S_6$ in which θe=π, second mode tone generation is started. In a state $S_7$ in which the jet angle θe increases from πto 3π/2, the audio frequency gradually decreases so as to cause variations in the tone volume and tone color in an actual air-reed instrument, which is not discussed in the aforementioned doctoral thesis. In a state $S_8$ in which θe=3π/2, a jump occurs from the second mode to the first mode, in other words, a one-octave-decrease occurs. During a state $S_9$ causing a jump, the audio frequency decreases to a half so that the jet angle θe correspondingly decreases to a half to suit 3π/4. In the leftward direction in FIG. 32, the jet velocity U(x) increases, and the slit-edge distance d decreases.

The following factors are taught in a master's thesis (entitled "Experimental Study on Jet Flow Distribution and Sound Characteristics in Air-Reed Instrument" written by Keita Arimoto in 2002 for Kyushu Art and Technology College) with respect to the jet velocity distribution as shown in FIG. 33.

(a) As the jet initial velocity becomes high, the jet velocity U(x) becomes dampened greatly.

(b) As the jet initial velocity becomes low and the slit-edge distance d becomes short, it is possible to neglect dampening of the jet velocity U(x).

Conventionally, a variety of technologies have been developed with respect to electronic wind instruments. For example, Japanese Unexamined Patent Application Publication No. H06-67675 teaches a tone generation control device for controlling a physical-model tone generator simulating an air-reed instrument in response to manual operation of a keyboard. With respect to electronic wind instruments having mouthpieces being blown with breaths, Japanese Unexamined Patent Application Publication No. S64-77091 teaches that tone generation is controlled to be started and stopped upon detection of an air flow by use of a breath sensor;

Japanese Unexamined Patent Application Publication No. H05-216475 teaches that musical tone characteristics are controlled and switched over in response to a breath intensity; Japanese Unexamined Patent Application Publication No. H07-199919 teaches that tone pitches are controlled in response to directions of breaths blown into a mouthpiece; and Japanese Unexamined Patent Application Publication No. 2002-49369 teaches that tone pitch information and tone volume information are produced based on a breath flow input into a mouthpiece, its velocity, and a total breath value, for example.

The aforementioned publications suffer from the following problems.

In the electronic wind instrument disclosed in Japanese Unexamined Patent Application Publication No. H06-67675, various pieces of control information regarding jet magnitude, jet velocity, and jet angle (or jet inclination) are produced based on key operation information produced by a keyboard, whereby the control information is converted into parameters which are then supplied to a physical-model tone generator. This may cause difficulty in realizing real-time musical performance in response to blowing.

In the other electronic wind instruments disclosed in the other publications described above, it may be possible to realize real-time musical performance in response to blowing; however, it is very difficult to realize octave-changeover-blowing techniques, which are applied to conventionally-known air-reed instruments such as flutes. It may be possible to realize octave-changeover-blowing techniques by applying the technology taught in the aforementioned doctoral thesis to the aforementioned electronic wind instruments. However, the following problems may occur irrespective of the teaching of the aforementioned technology of the doctoral thesis.

(1) In the realization of octave changeover control based on the present tone-generation mode and the jet angle $\theta e$, the aforementioned equation 1 needs an actual audio frequency being calculated and substituted therefor. In the case of an electronic wind instrument which differs from a natural wind instrument, it is very difficult to calculate an actual audio frequency in advance.

(2) In order to accurately calculate the jet transmission time $\tau e$, it is necessary to perform sensing regarding the jet velocity at prescribed positions. In actuality, it is very difficult to arrange a plurality of flow sensors along a jet flow path of an electronic wind instrument.

In order to solve the aforementioned problems, it is strongly demanded to provide a tone control device which is capable of simulating octave-changeover-blowing techniques (conventionally used in air-reed instruments) in electronic wind instruments. Herein, octave changeover control may be realized by means of the tone control device based on various pieces of information regarding the jet velocity, jet length (i.e., a distance between a jet outlet and an edge), and fingering state, which are detected in an electronic wind instrument. Herein, musical tones may be varied in octaves when strong blowing is applied to low-pitch ranges. This may cause a difficulty in producing musical tones having relatively high tone volumes without varying octaves thereof.

It may be possible to realize octave changeover control based on the jet length only in order not to cause octave variations due to the strength of breaths. This method may realize octave-changeover-blowing techniques by simply changing lip-edge distances of electronic wind instruments, wherein strong blowing applied to low-pitch ranges may not always cause octave variations. However, players who are accustomed to octave-changeover-blowing techniques by controlling the strength of breaths without changing lip-edge distances may experience inconveniences in which musical tones cannot always be changed in octaves by simply controlling the strength of breaths.

In order to produce a relatively high tone volume on a flute that is actually played in low-pitch ranges, the aforementioned tone control device cannot cope with such an execution because it has a relatively small range of control regarding the tone volume.

In actuality, a flute is played to produce a tone color including high-order overtones by changing the jet eccentricity (i.e., positional shifts of a jet at an edge in a vertical direction) in order to increase pitches in the sense of hearing. The aforementioned tone control device cannot cope with such an execution because it has a relatively narrow range of control regarding the tone color.

In actuality, a player playing a flute may compensate for variations of pitches due to changes of registers and breathing by changing an area of lips in contact with a blow hole, thus causing variations of embouchure such as internal blowing and external blowing. The aforementioned tone control device cannot cope with such an execution because it has a relatively small range of control regarding the tone pitch.

SUMMARY OF THE INVENTION

It is an object of the present invention to provide a brand-new tone control device applied to an electronic wind instrument, which realizes octave-changeover-blowing techniques depending upon the strength of breaths by enlarging ranges of control regarding the tone volume, tone color, and tone pitch.

The present invention is directed to a tone control device and its program adapted to an electronic wind instrument having a tube, a lip plate having a blow hole, a plurality of tone keys, and a tone generator.

In a first aspect of the present invention, the tone control device includes a jet flow sensor for detecting a velocity or strength of a jet flow, which is caused by blowing air into the blow hole and is transmitted so as to collide with an edge, wherein a jet width is detected based on the output of the jet flow sensor including a plurality of flow sensors horizontally arranged with respect to the edge; a jet length sensor for detecting a jet length within a range between the lip plate and the edge; a jet transmission time detector for detecting a jet transmission time in which a jet travels from a jet outlet in proximity to the blow hole to the edge on the basis of the output of the jet flow sensor and the output of the jet length sensor; a fingering state detector for detecting a fingering state based on the operated states of the tone keys; an audio frequency designator for designating an audio frequency realizing a desired note and a desired octave based on the fingering state; a jet angle calculator for calculating a jet angle by way of a multiplication using the audio frequency and the jet transmission time; and a tone generator controller for controlling the tone generator in terms of an amplitude and a tone pitch of a musical tone signal based on the output of the jet flow sensor, wherein the tone generator controller controls the musical tone signal to be increased in tone pitch by one octave when the jet angle belongs to a first range, and the tone generator controller controls the musical tone signal to be decreased in tone pitch by one octave when the jet angle belongs to a second range higher than the first range during generation of the musical tone signal whose tone pitch is once increased by one octave.

The aforementioned tone control device is designed to detect a jet angle by use of an audio frequency of a musical tone signal designated by a fingering state; hence, this eliminates the necessity of actually detecting the audio frequency. During generation of a musical tone signal whose tone pitch matches a desired octave, the tone pitch is automatically increased by one octave when the jet angle is decreased into the first range. This allows the user (or the player of an electronic wind instrument) to maintain a blowing state, which makes the jet angle reach the first range, thus generating a musical tone signal whose tone pitch is increased by one octave. Specifically, this does not require the user to perform blowing causing an increase of the jet angle from $\pi/2$ to $\pi$ as shown in FIG. 32. In addition, during generation of a musical tone signal whose tone pitch is once increased by one octave, the tone pitch is compulsorily decreased by one octave when the jet angle is increased to reach the second range higher than the first range. This allows the user to maintain a blowing state, which makes the jet angle reach the second range, thus generating a musical tone signal whose tone pitch is decreased by one octave. Specifically, this does not require the user to perform blowing causing a decrease of the jet angle from $3\pi/2$ to $3\pi/4$ as shown in FIG. 32. In short, the present invention allows the user to easily perform an octave-changeover-blowing technique due to the strength of a breath. Furthermore, an octave changeover operation has a hysteresis characteristic by making the second range be higher than the first range. In other words, a one-octave-increase of the tone pitch does not occur even when the user plays an electronic wind instrument to slightly vary pitches causing variations of the jet angle outside of the first range; and a one-octave-decrease of the tone pitch does not occur even when the user plays an electronic wind instrument to slightly vary pitches causing variations of the jet angle outside of the second range. This ensures specific executions such as pitch bending techniques and vibrato techniques. Moreover, the amplitude of a musical tone signal is controlled by detecting the jet width; hence, this realizes musical performance of high tone volume by simply increasing the jet width with respect to low-pitch sounds. As a result, the present invention copes with variations of embouchure due to various playing techniques, which are adapted to flutes and the like; hence, the user can enjoy playing an electronic wind instrument approximately simulating a flute.

In a second aspect of the present invention, the tone control device includes a jet flow sensor for detecting a velocity or an intensity of a jet flow, which is caused by blowing a breath into the blow hole and is transmitted so as to collide with an edge, wherein a jet eccentricity or a jet thickness is detected based on the output of the jet flow sensor including a plurality of flow sensors vertically arranged with respect to the edge; a jet length sensor for detecting a jet length within a range between the lip plate and the edge; a jet transmission time detector for detecting a jet transmission time in which a jet travels from a jet outlet in proximity to the blow hole to the edge on the basis of the output of the jet flow sensor and the output of the jet length sensor; a fingering state detector for detecting a fingering state based on the operated states of the tone keys; an audio frequency designator for designating an audio frequency realizing a desired note and a desired octave based on the fingering state; a jet angle calculator for calculating a jet angle by way of a multiplication using the audio frequency and the jet transmission time; and a tone generator controller for controlling the tone generator in terms of a tone color and/or a tone volume of a musical tone signal based on the output of the jet flow sensing means, wherein the tone generator control means controls the musical tone signal to be increased in tone pitch by one octave when the jet angle belongs to a first range, and the tone generator control means controls the musical tone signal to be decreased in tone pitch by one octave when the jet angle belongs to a second range higher than the first range during generation of the musical tone signal whose tone pitch is once increased by one octave.

In the above, the jet eccentricity is accurately detected with reference to a jet flow distribution curve, which is presumed based on the output of the jet flow sensor.

In a third aspect of the present invention, the tone control device includes a jet flow sensor for detecting a velocity or strength of a jet flow, which is caused by blowing a breath into the blow hole and is transmitted so as to collide with an edge;

a jet length sensor for detecting a jet length within a range between the lip plate and the edge; a lip contact sensor for detecting a lip contact value or a lip touch value in connection with the blow hole of the lip plate; a jet transmission time detector for detecting a jet transmission time in which a jet travels from a jet outlet in proximity to the blow hole to the edge on the basis of the output of the jet flow sensor and the output of the jet length sensor; a fingering state detector for detecting a fingering state based on the operated states of the tone keys; an audio frequency designator for designating an audio frequency realizing a desired note and a desired octave based on the fingering state; a jet angle calculator for calculating a jet angle by way of a multiplication using the audio frequency and the jet transmission time; and a tone generator controller for controlling the tone generator in terms of a tone pitch of a musical tone signal based on the output of the jet flow sensor and the output of the lip contact sensor, wherein the tone generator controller controls the musical tone signal to be increased in tone pitch by one octave when the jet angle belongs to a first range, and the tone generator controller controls the musical tone signal to be decreased in tone pitch by one octave when the jet angle belongs to a second range higher than the first range during generation of the musical tone signal whose tone pitch is once increased by one octave.

In the above, the user can change pitches through blowing of an electronic wind instrument by varying the lip contact value applied to the blow hole or by varying the lip touch value applied to the proximity of the blow hole, thus realizing various executions for appropriately correcting pitch variations.

As described above, the tone control device of the present invention performs octave changeover control based on the jet angle and the presently played state of an electronic wind instrument. Hence, the present invention can easily simulate octave-changeover-blowing techniques adapted to air-reed instruments such as flutes.

In addition, the tone control device of the present invention is designed to control the amplitude of a musical tone signal in response to the jet width, to control the tone color of a musical tone signal in response to the jet eccentricity or the jet thickness, and to control the tone pitch of a musical tone signal in response to the lip contact value applied to the blow hole or the lip touch value applied to the proximity of the blow hole. This noticeably increases controllable ranges with regard to the tone volume, tone color, and tone pitch.

BRIEF DESCRIPTION OF THE DRAWINGS

These and other objects, aspects, and embodiments of the present invention will be described in more detail with reference to the following drawings, in which:

FIG. 29A shows a musical score including two measures in relation to the playing of an air-reed instrument;

FIG. 29B diagrammatically shows a fingering state of the air-reed instrument, which produces a note E in different octaves in relation to a first measure shown in FIG. 29A;

FIG. 29C diagrammatically shows a fingering state of the air-reed instrument, which produces a note F in different octaves in relation to a second measure shown in FIG. 29A;

DESCRIPTION OF THE PREFERRED EMBODIMENT

This invention will be described in further detail by way of examples with reference to the accompanying drawings.

Figure 1:
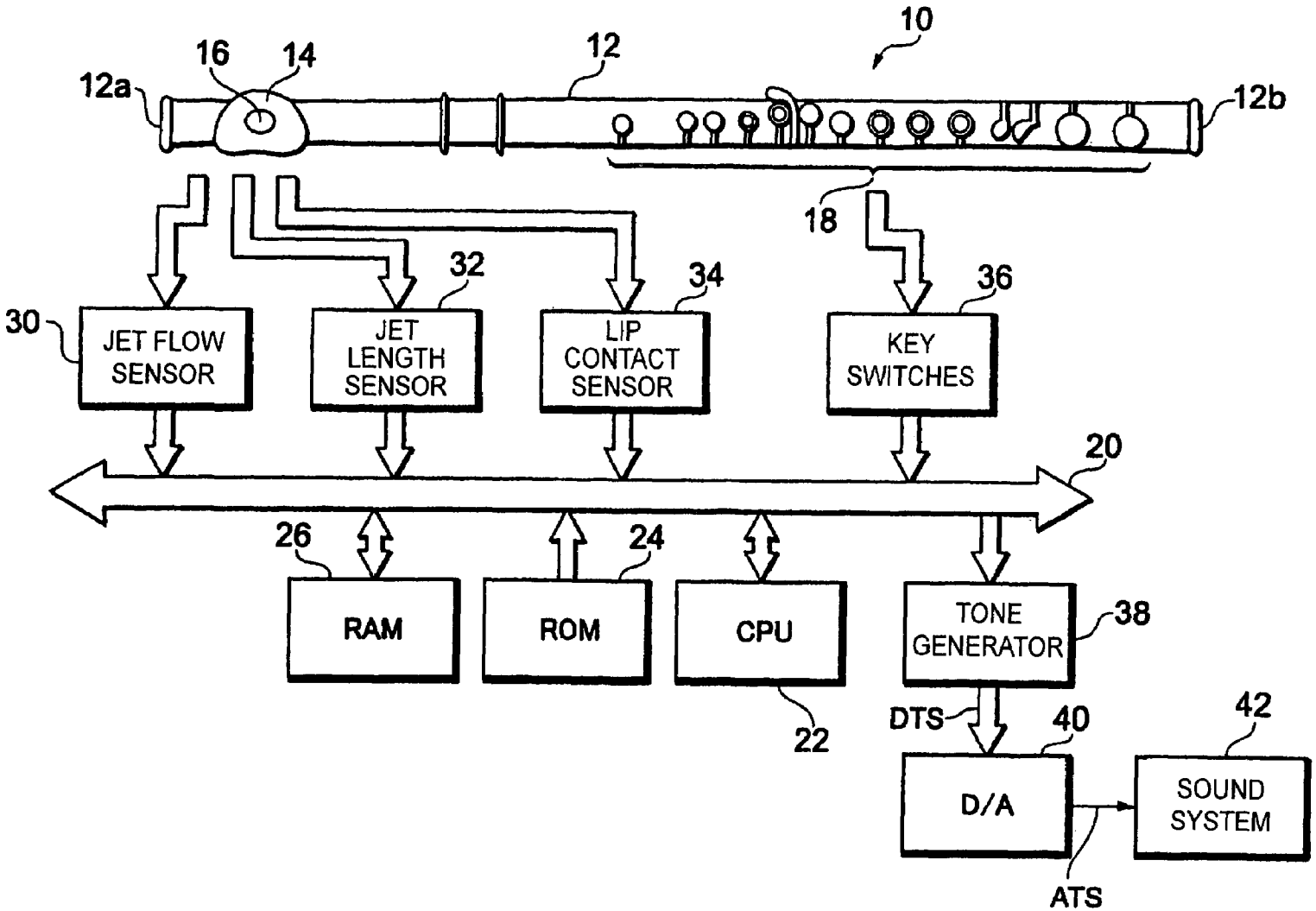
FIG. 1 is a block diagram showing a circuitry configuration of an electronic wind instrument having a wind instrument controller interconnected with functional blocks in accordance with a preferred embodiment of the present invention.

FIG. 1 is a block diagram showing a circuitry configuration of an electronic wind instrument, which performs tone control using a micro-computer, in accordance with a preferred embodiment of the present invention.

In FIG. 1, a wind instrument controller 10 whose shape resembles the typical shape of a flute has a thin hollow tube 12 that is elongated from a closed end 12*a* to an open end 12*b*, a lip plate 14 having a blow hole 16, which interconnects with a cavity of the tube 12, and a plurality of tone keys 18 for designating tone pitches. The wind instrument controller 10 is not designed to independently produce sound as of a flute; hence, the tube 12 can be appropriately changed in dimensions in consideration of users' easy-to-handle requirements. Incidentally, the closed end 12*a* can be changed to an open end.

The lip plate 14 is equipped with a jet flow sensor 30 for detecting a jet flow velocity, a jet length sensor 32 for detecting a jet length, and a lip contact sensor 34 for detecting a lip contact area of the blow hole 16. Details of the aforementioned sensors and their structures will be described later with reference to FIGS. 4, 7, 9, 10, 12, 13, and 15. The tone keys 18 are equipped with key switches 36 for detecting operations applied thereto.

There is provided a bus 20 interconnected with a central processing unit (CPU) 22, a read-only memory (ROM) 24, and a random-access memory (RAM) 26 as well as the jet flow sensor 30, the jet length sensor 32, the lip contact sensor 34, the key switches 36 and a tone generator 38. In addition, a keyboard and a display (not shown) are also interconnected to the bus 20. The CPU 22 performs various types of processing to realize tone control in accordance with programs stored in the ROM 24. Details of the processing will be described later in conjunction with FIGS. 20 to 26. The ROM 24 stores various types of data tables in addition to prescribed programs. The RAM 26 includes various storage areas corresponding to flags and registers, which are used for the CPU 22 to perform various types of processing.

The jet flow sensor 30 is attached to the lip plate 14 so as to produce jet flow data based on the output thereof. The jet length sensor 32 is attached to the lip plate 14 so as to produce jet length data representing the jet length. The lip contact sensor 34 is attached to the lip plate 14 so as to produce lip contact data representing the lip contact area of the blow hole 16. The key switches 36 are attached to the tone keys 18 so as to produce fingering data representing fingering states of the tone keys 18.

Figure 2:
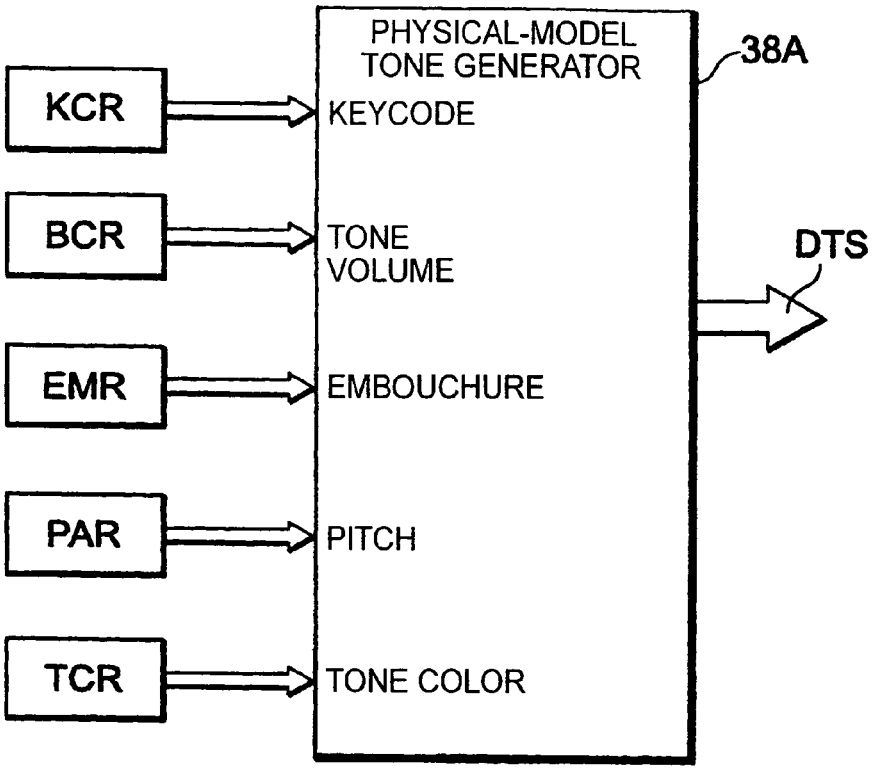
FIG. 2 is a block diagram showing the details of a tone generator shown in FIG. 1.
Figure 3:
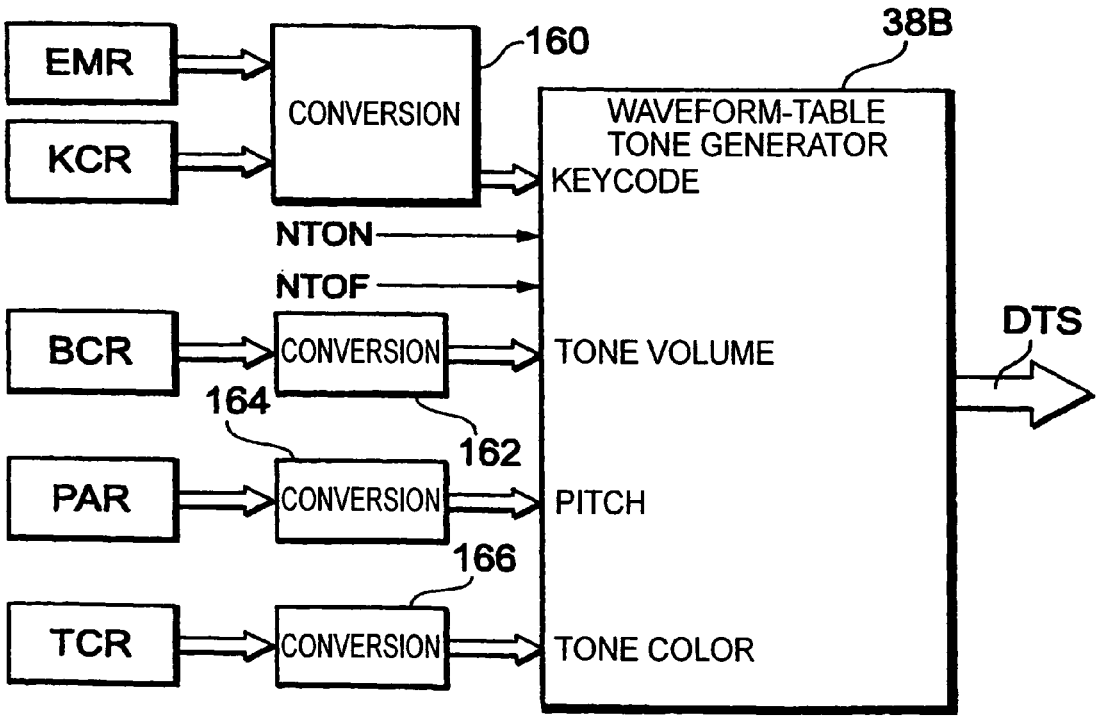
FIG. 3 is a block diagram showing another constitution of the tone generator shown in FIG. 1.

The tone generator 38 has a physical-model tone generator 38A shown in FIG. 2, which outputs digital musical tone signals DTS. The physical-model tone generator 38A is supplied with keycodes (i.e., tone-pitch control inputs) from a register KCR, tone-volume control values (i.e., tone-volume control inputs) from a register BCR, embouchure control values (i.e., tone-pitch control inputs) from a register EMR, pitch control values (i.e., pitch control inputs) from a register PAR, and tone-color control values (i.e., tone-color control inputs) from a register TCR. All of the registers KCR, BCR, EMR, PAR, and TCR are included in the RAM 26. The tone-pitch control inputs are used to control tone pitches in units of semi-tones in accordance with scales; and pitch control inputs are used to control tone pitches in units of cents in accordance with pitch bending, for example. The tone generator 38 may include a waveform table tone generator (or a waveform readout tone generator) 38B as shown in FIG. 3, details of which will be described later.

Digital musical tone signals DTS output from the tone generator 38 are converted into analog musical tone signals ATS by means of a digital-to-analog converter 40. Analog musical tone signals ATS are supplied to a sound system 42 (including a power amplifier and a speaker), which thus produces musical tones.

Figure 4:
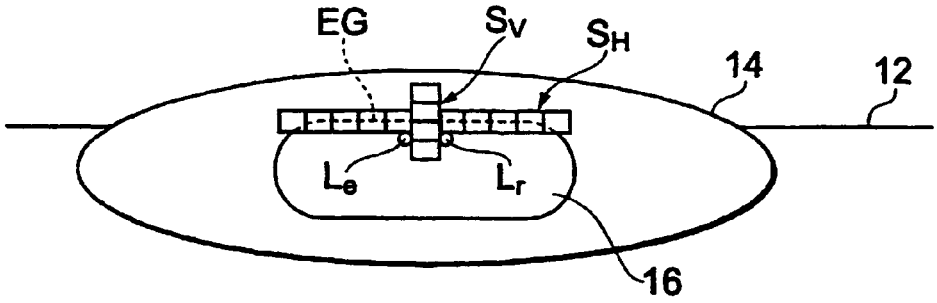
FIG. 4 is a cross-sectional view showing the structure including a jet flow sensor and a jet length sensor shown in FIG. 1.

FIG. 4 diagrammatically shows the overall structure including the jet flow sensor 30 and the jet length sensor 32. The lip plate 14 is equipped with horizontal sensors $S_H$ along with an edge EG, which a jet blown by the blow hole 16 flows towards, and vertical sensors $S_V$ that are arranged in the front portion of the edge EG so as to cross the horizontal sensors $S_H$ at a right angle therebetween. For example, the vertical sensors $S_V$ include four flow sensors vertically arranged with respect to the edge EG; and the horizontal sensors $S_H$ include ten flow sensors, in which five flow sensors are arranged horizontally in the right side of the vertical sensors $S_V$, and the other five flow sensors are arranged horizontally in the left side of the vertical sensors $S_V$. Each of the flow sensors is designed to detect a jet flow velocity. It is possible to substitute pressure sensors, each of which is designed to detect a jet intensity, for the flow sensors.

Just below the edge EG, a light-emitting element Le is arranged in the left side of the vertical sensors $S_V$, and a light-receiving element Lr is arranged in the right side of the vertical sensors $S_V$. The light-emitting element Le and the light-receiving element Lr form the jet length sensor 32, the detailed operation of which will be described later with reference to FIG. 9.

The horizontal sensors $S_H$ are used to detect a jet width, details of which will be described below.

Among the horizontal sensors $S_H$ subjected to horizontal alignment, the sensor arranged at the center of the horizontal alignment (corresponding to the center of the edge EG) is regarded as a reference position having zero positional distance from the center. The outputs of the five sensors arranged in the right side counted from the reference position are sequentially examined in an order from the rightmost sensor to the central sensor so as to detect a sensor whose output exceeds a prescribed threshold Uth; then, the position of the detected sensor is set to VR [mm]. In addition, the outputs of the five sensors arranged in the left side counted from the reference position are sequentially examined in an order from the leftmost sensor to the central sensor so as to detect a sensor whose output exceeds the threshold Uth; then, the position of the detected sensor is set to VL [mm]. Herein, the effective jet width is detected as VR-VL [mm].

Instead of the aforementioned method, it is possible to use a simple method for detecting the jet width. That is, under a presumption in which the jet width lies symmetrically in the left side and the right side, a plurality of sensors are horizontally arranged only in the left side or the right side along the edge EG. A half of the jet width is detected based on the outputs of the sensors with respect to the left side or the right side; then, it is doubled so as to produce the overall jet width which lies both in the left side and the right side. This method reduces the total number of the horizontal sensors $S_H$ to a half, which may contribute to economy.

Figure 5:
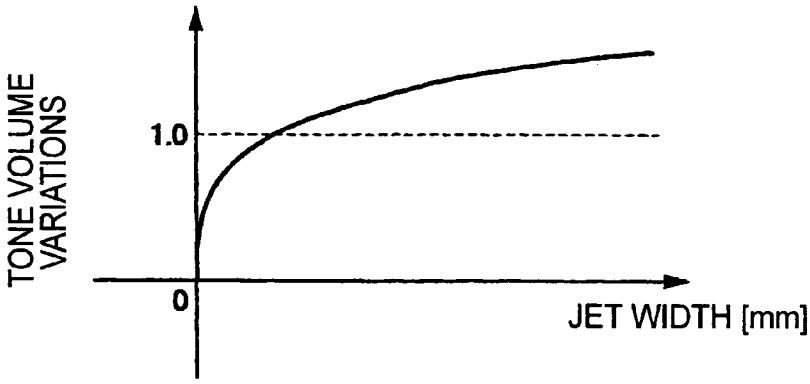
FIG. 5 is a graph showing an example of the content of a tone volume table representing the relationship between tone volume variations and jet width.

FIG. 5 shows an example of the content of a tone volume table, wherein a horizontal axis represents a jet width [mm], and a vertical axis represents tone volume variations. As shown in FIG. 5, as the jet width increases, the tone volume variations gradually increase. The ROM 24 stores tone volume variation data, which are produced with respect to prescribed jet widths respectively in accordance with FIG. 5, in the form of the tone volume table. Thus, the tone volume variation data are read from the ROM 24 in correspondence to the detected jet width and are then multiplied by tone volume control data so as to control amplitudes of musical tone signals.

Figure 6:
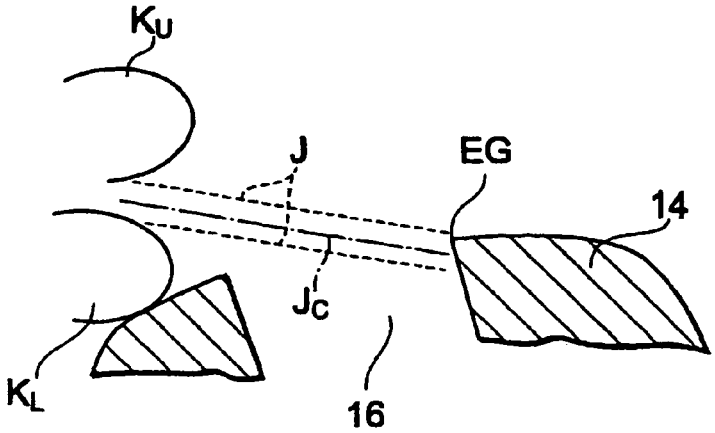
FIG. 6 is a cross-sectional view diagrammatically showing a blow hole of a lip plate of the wind instrument controller shown in FIG. 1, in which a jet is blown towards and collides with an edge.

FIG. 6 diagrammatically shows that a jet J is blown towards and collides with the edge EG. Specifically, the jet J is blown with a certain thickness from the place between an upper lip $K_U$ and a lower lip $K_L$ and then collides with the lip plate 14 in the periphery of the blow hole 16. Normally, a center Jc of the jet J may be deviated in position from the edge EG; hence, such a positional deviation is called "jet eccentricity".

Next, the method for detecting the jet eccentricity will be described with reference to FIG. 7, in which parts identical to those shown in FIG. 6 are designated by the same reference numerals and symbols. Four flow sensors $S_1$ to $S_4$ forming the vertical sensors $S_V$ are arranged in the front portion of the edge EG. Each of the flow sensors $S_1$ to $S_4$ has a sensing position at the center thereof. The boundary between the flow sensors $S_2$ and $S_3$ matches the vertical position of the edge EG.

Figure 7:
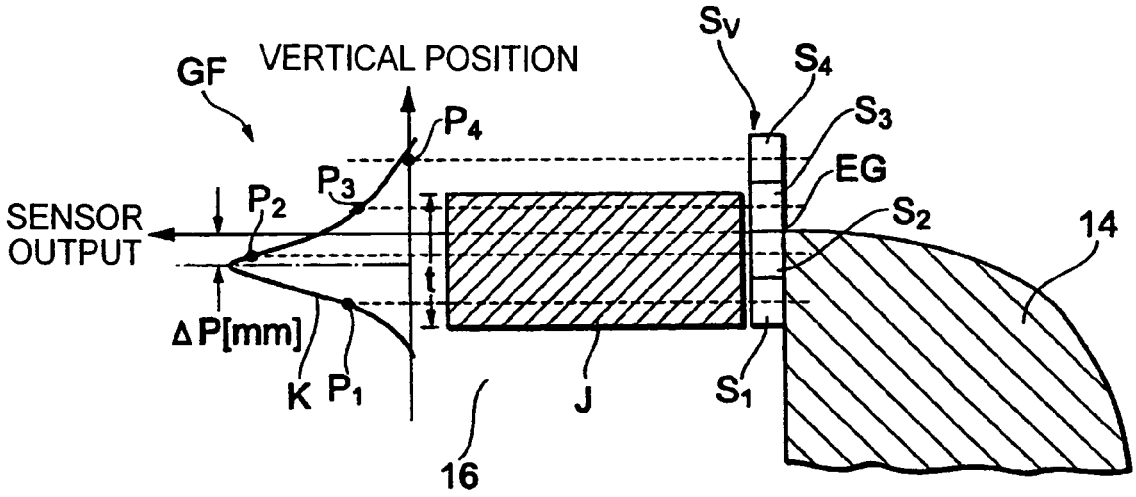
FIG. 7 is a cross-sectional view diagrammatically showing the blow hole of the lip plate of the wind instrument controller, which is used for explaining detection of jet eccentricity.

When the jet J having the prescribed thickness collides with the vertical sensors $S_V$, the flow sensors $S_1$ to $S_4$ produce sensor outputs $P_1$ to $P_4$, which are plotted in the form of a graph GF shown in the left-side area of the jet J illustrated in FIG. 7. In the graph GF, a vertical axis represents a vertical position, and a horizontal axis represents a sensor output, wherein the sensor outputs $P_1$ to $P_4$ are plotted in relation to the positions of the sensors $S_1$ to $S_4$. Incidentally, the horizontal axis matches the edge EG in position. Herein, the sensor output $P_2$ has a maximum value within the sensor outputs $P_1$ to $P_4$, so that the jet eccentricity is detected as a positional deviation of the point $P_2$ counted from the horizontal axis.

It is possible to employ another method for detecting the jet eccentricity as follows:

A sensor output distribution curve K is presumed by plotting the sensor outputs $P_1$ to $P_4$ in relation to the positions of the sensors $S_1$ to $S_4$, wherein a positional shift is detected between the peak position of the sensor output distribution curve K and the horizontal axis and is thus used as a jet eccentricity ΔP [mm]. Suppose that the total number of flow sensors is set to n (where "n" is an integral number and is set to 4 in FIG. 7), whereby the sensor output distribution curve K is presumed as a curve of (n−1)-order function, so that the maximum value (or the peak position) thereof is used to determine the jet eccentricity ΔP. According to this method, it is possible to accurately detect the jet eccentricity by use of plural sensors, which are arranged in a discrete manner. It may be possible to use only two flow sensors (e.g., $S_2$ and $S_3$) that are arranged symmetrically with respect to the prescribed center position corresponding to the position of the edge EG, wherein the jet eccentricity is detected based on a difference between the outputs of the two sensors.

Figure 8:
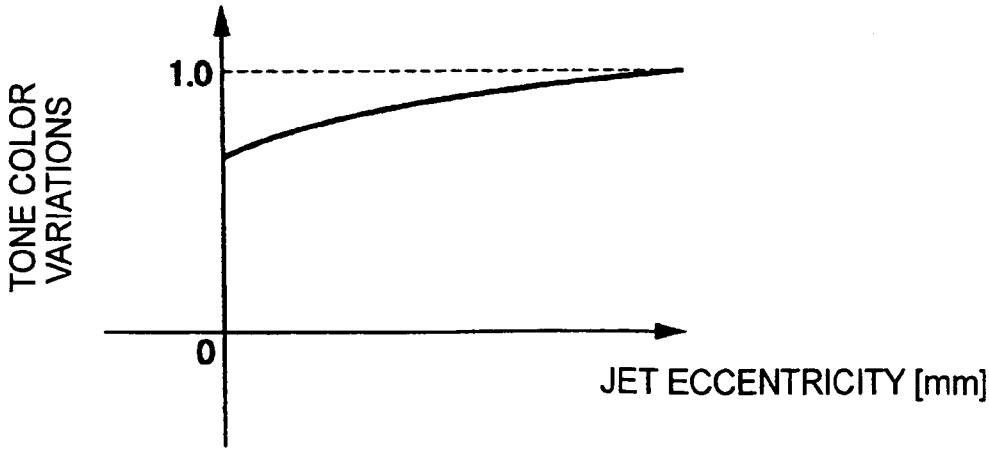
FIG. 8 is a graph showing an example of the content of a tone color table representing the relationship between tone color variations and jet eccentricity.

FIG. 8 shows an example of the content of a tone color table, wherein a horizontal axis represents jet eccentricity [mm], and a vertical axis represents tone color variations. The content of the tone color table shown in FIG. 8 is applied to a waveform-table tone generator 38B shown in FIG. 3, which is used for the tone generator 38 shown in FIG. 1. It shows that variations of low-pass filter coefficients (serving as tone color variations) are gradually changed close to 1.0 as the jet eccentricity increases. The ROM 24 stores low-pass filter coefficient variation data in the form of the tone color table in relation to values of jet eccentricity in accordance with FIG. 8; hence, they are read from the ROM 24 in response to the detected jet eccentricity and are then multiplied by low-pass filter coefficient control data so as to control tone colors of musical tone signals.

When the physical-model tone generator 38A shown in FIG. 2 is used for the tone generator 38, offset values of read addresses used for the reading of a non-linear table correspond to tone color variations. Herein, similar to the aforementioned technique used for FIG. 8, relationships between the prescribed values of the jet eccentricity and the offset values of the read addresses are stored in the ROM 24 in the form of a tone color table in advance; thereafter, an offset value of a read address suiting the detected jet eccentricity is read from the ROM 24 and is supplied to the tone generator 38A as tone color control data, thus controlling the tone color of musical tone signals.

In the aforementioned description, the jet eccentricity is detected by use of the vertical sensors $S_V$ and is then used to control the tone color of musical tone signals. Instead, it is possible to control the tone volume of musical tone signals in response to the detected jet eccentricity. Alternatively, it is possible to detect thickness t of the jet J based on the sensor outputs of the vertical sensors $S_V$, thus controlling musical tone signals based on the detection result in terms of the tone color and/or the tone volume.

Figure 9:
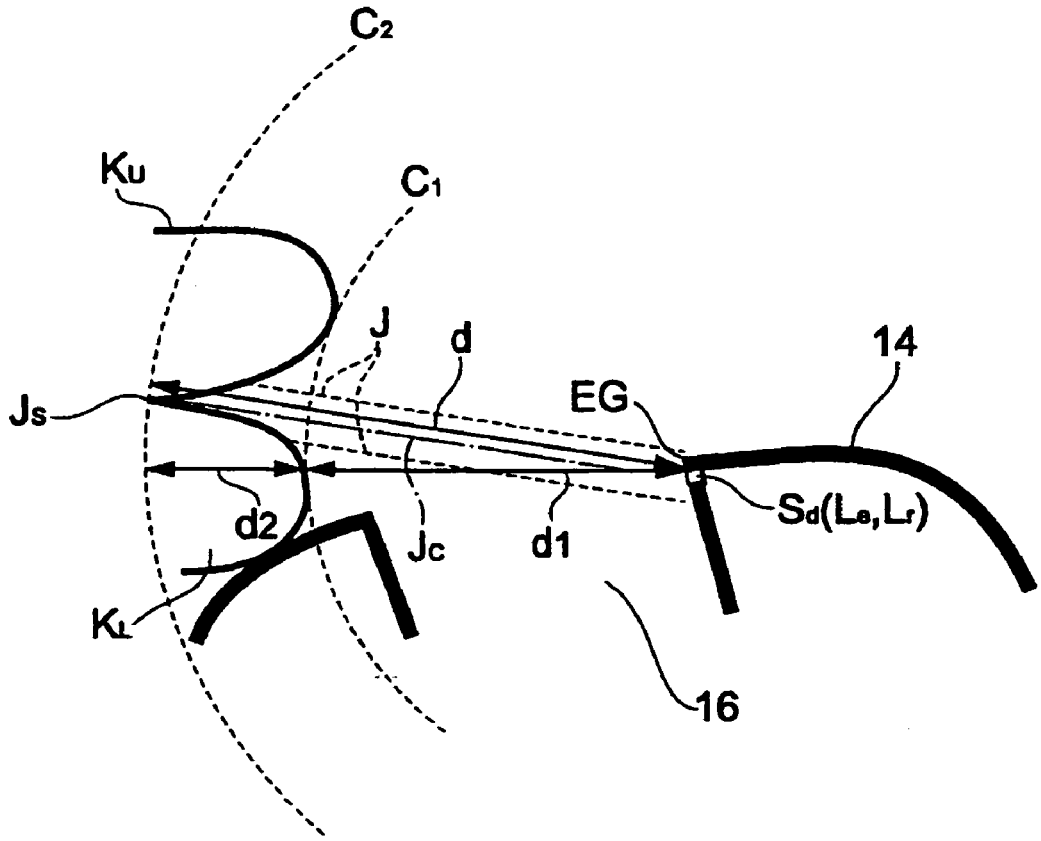
FIG. 9 is a schematic illustration regarding the relationship between user's lips, blow hole, and lip plate, which is used for explaining detection of a jet length.

Next, a method for detecting a jet length will be described with reference to FIG. 9, in which parts identical to those shown in FIG. 6 are designated by the same reference numerals and symbols. A jet length sensor Sd for detecting the jet length is constituted by the aforementioned light-emitting element Le and the light-receiving element Lr, which are arranged just below the edge EG of the lip plate 14. When light emitted from the light-emitting element Le is irradiated to the user's lower lip $K_L$ across the blow hole 16, reflected light occurs at the lower lip $K_L$ and is then introduced into the light-receiving element Lr, which in turn produces a light-reception output in response to the intensity of the reflected light. Hence, it is possible to detect a distance d1 between the lower lip and the edge based on the light-reception output.

Figure 30:
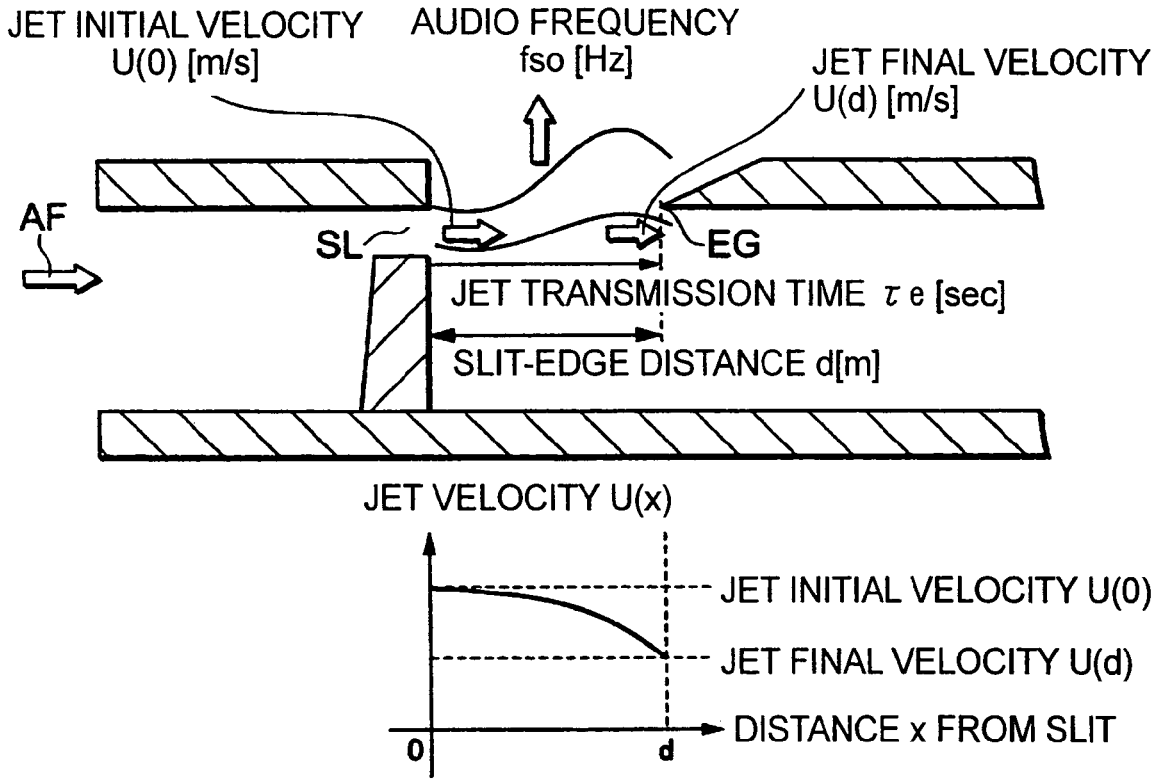
FIG. 30 diagrammatically shows a jet flow in an air-reed instrument in a cross section together with a simple graph showing the relationship between a distance from a slit and a jet velocity.

A jet outlet Js corresponds to a jet blow occurring between the upper lip Ku and the lower lip $K_L$. As shown in FIG. 9, a circle $C_1$ is drawn about a center corresponding to the edge EG so as to pass through the tip end of the lower lip $K_L$, and a circle $C_2$ is also drawn to pass through the jet outlet Js. Herein, a distance d between the jet outlet and the edge is longer than the distance d1 between the lower lip and the edge by a distance d2 between the jet outlet and the tip end of the lower lip. That is, the distance d can be calculated using the distances d1 and d2 by way of an equation of d=d1+d2. The distance d shown in FIG. 9 corresponds to the aforementioned slit-edge distance d shown in FIG. 30, whereby it is used to determine the jet transmission time τe and to assess a lip's proximity toward the edge EG. Since the distance d2 decreases as the tone pitch increases, it may be preferable to make determination in response to tone pitches, in other words, it may be preferable to make determination using pitch scaling. Instead, it is possible to use an average value for the representation of all tone pitches.

Figure 10:
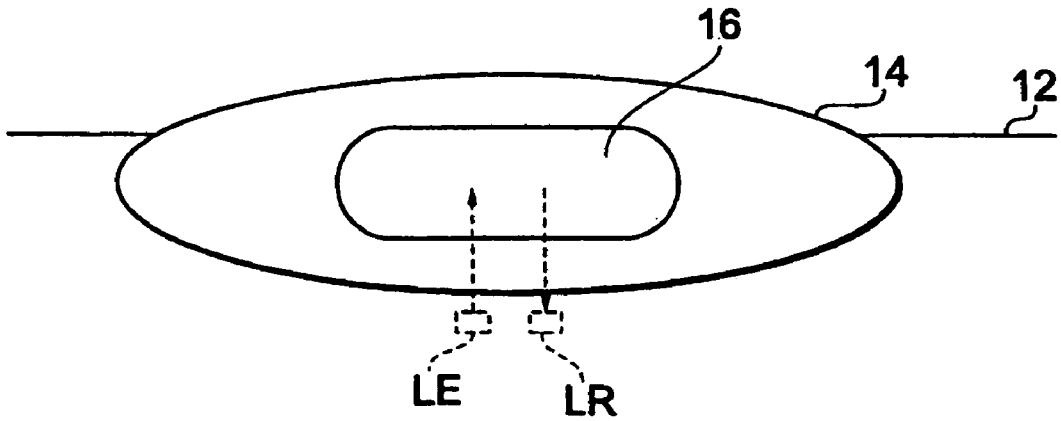
FIG. 10 is an illustration showing a sensor arrangement for detecting a lip contact value in relation to the blow hole and lip plate.

FIG. 10 shows an example of a sensor arrangement adapted to the lip contact sensor 34. Specifically, the lip contact sensor 34 is constituted by a light-emitting sensor LE and a light-receiving sensor LR, which are arranged opposite to each other with respect to the blow hole 16 of the lip plate 14 inside of the tube 12 of the wind instrument controller 10 shown in FIG. 1. The light-emitting element LE irradiates light such as an infrared ray (which is scattered to a certain degree) upwardly. The irradiated light is reflected on the user's lips, so that the reflected light is received by the light-receiving element LR. Since the amount of the received light increases as a lip contact value increases, it is possible to detect the lip contact value based on a light-reception output of the light-receiving element LR.

Figure 11:
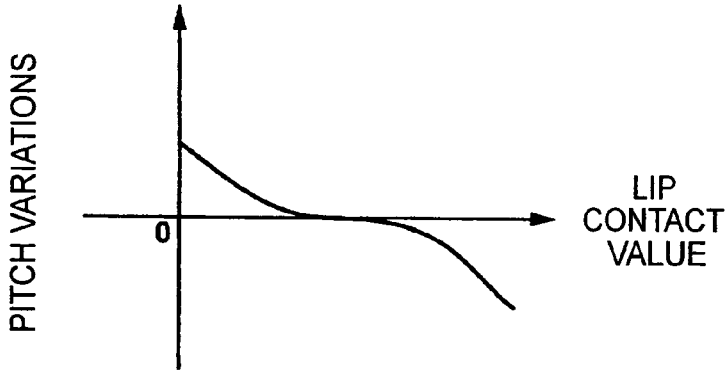
FIG. 11 is a graph showing an example of the content of a pitch table representing the relationship between pitch variations and lip contact value.

FIG. 11 is a graph showing an example of the content of a pitch table, in which a horizontal axis represents a lip contact value, and a vertical axis represents pitch variations. The graph of FIG. 11 is produced by defining a standard state realizing an intermediate lip contact value, so that as the lip contact value decreases from the standard state, pitch variations increase, while as the lip contact value increases from the standard state, pitch variations decrease. The ROM 24 stores pitch variations data in relation to prescribed lip contact values in accordance with FIG. 11 in the form of the pitch table; hence, pitch variation data are read from the ROM 24 in correspondence with the detected lip contact value. There is introduced a mathematic expression of PC×(1.0+Pi) (where PC designates pitch control data, and Pi designates pitch variation data read from the ROM 24), by which a pitch control value is produced and is supplied to the tone generator 38A, thus controlling pitches of musical tone signals.

Figure 12:
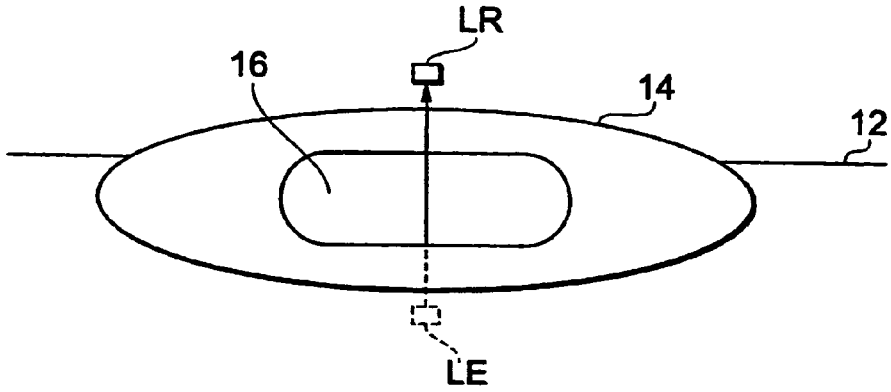
FIG. 12 is an illustration showing another sensor arrangement for detecting a lip contact value in relation to the blow hole and lip plate.

FIG. 12 shows another sensor arrangement for detecting a lip contact value, wherein parts identical to those shown in FIG. 10 are designated by the same reference numerals and symbols. Herein, the light-emitting element LE is arranged inside of the tube 12, and the light-receiving element LR is arranged above the blow hole 16 and opposite to the light-emitting element LE, wherein light that is transmitted without being blocked by the user's lips is received by the light-receiving element LR. Since the amount of the received light of the light-receiving element LR decreases as the lip contact value applied to the blow hole 16 increases, it is possible to detect the lip contact value based on the light-reception output of the light-receiving element LR. Similar to the aforementioned sensor arrangement shown in FIG. 11, it is possible to control pitches of musical tones in the sensor arrangement shown in FIG. 12.

Figure 13:
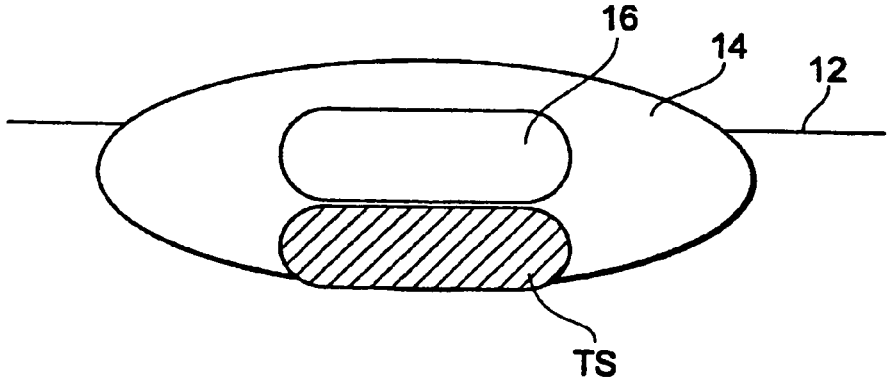
FIG. 13 is an illustration showing a sensor arrangement for detecting a lip touch value in relation to the blow hole and lip plate.

FIG. 13 shows an example of a sensor arrangement for detecting a lip touch value, wherein a touch sensor TS is arranged below the blow hole 16 of the lip plate 14 so as to detect a lip touch value (or a lip's contact area) in proximity to the blow hole 16. As the touch sensor TS, it is possible to use a pressure sensor or a membrane switch. The membrane switch includes a plurality of switching elements arranged in a plane, wherein by counting the number of switching elements being depressed, it is possible to produce an output corresponding to the lip's contact area.

Figure 14A:
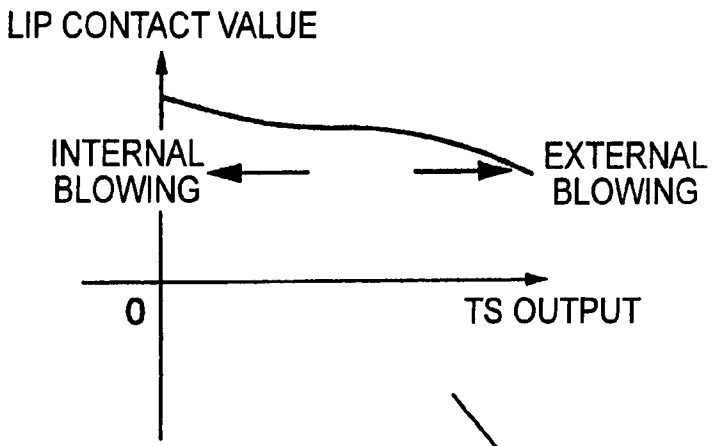
FIG. 14A shows the relationship between the output of a touch sensor attached below the blow hole and a lip contact value.
Figure 14B:
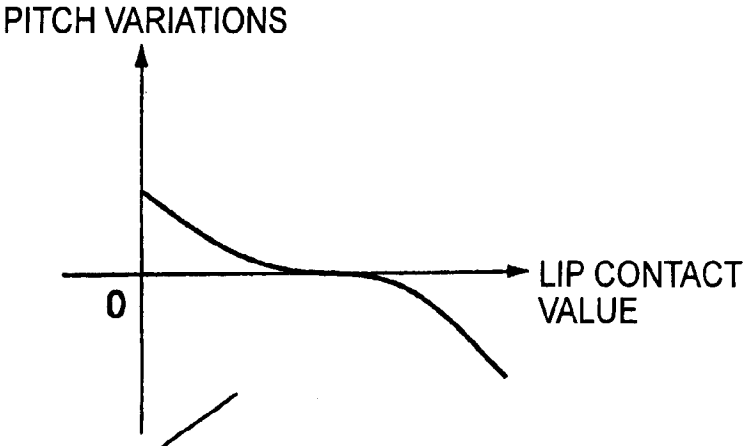
FIG. 14B shows the relationship between a lip contact value and pitch variations.
Figure 14C:
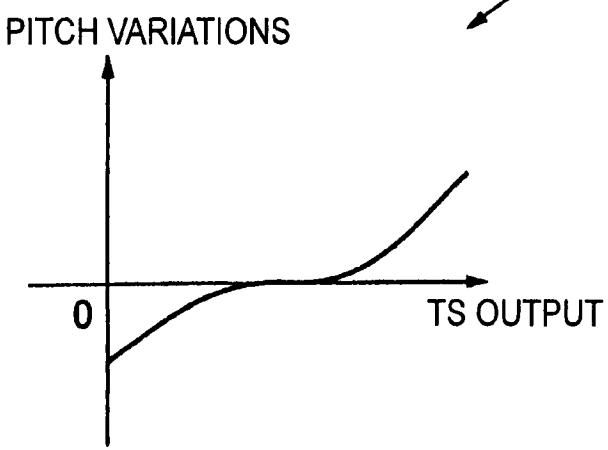
FIG. 14C shows the relationship between the output of the touch sensor and pitch variations.

FIG. 14A shows the relationship between the output of the touch sensor TS and the lip contact value applied to the blow hole 16, which shows that internal blowing may tend to occur in response to a relatively small output of the touch sensor TS (i.e., a relatively small lip's contact area), while external blowing may tend to occur in response to a relatively high output of the touch sensor TS (i.e., a relatively large lip's contact area). Similar to FIG. 11, FIG. 14B shows the relationship between the lip contact value and pitch variations. FIG. 14C shows the relationship between the output of the touch sensor TS (representing the lip's contact area) and pitch variations on the basis of FIGS. 14A and 14B. It shows that pitches decrease as the output of the touch sensor TS decreases so as to indicate a high tendency of internal blowing, while pitches increase as the output of the touch sensor TS increases so as to indicate a high tendency of external blowing.

The ROM 24 stores pitch variation data in relation to prescribed output values of the touch sensor TS in accordance with FIG. 14C in the form of a pitch table; hence, pitch variation data are read from the ROM 24 in response to the detected output value of the touch sensor TS. As described previously in conjunction with FIG. 11, there is introduced a mathematical expression of PC×(1.0+Pi) (where PC designates pitch control data, and Pi designates pitch variation data read from the ROM 24) so as to produce a pitch control value, which is supplied to the tone generator 38A, thus controlling pitches of musical tone signals.

Figure 15:
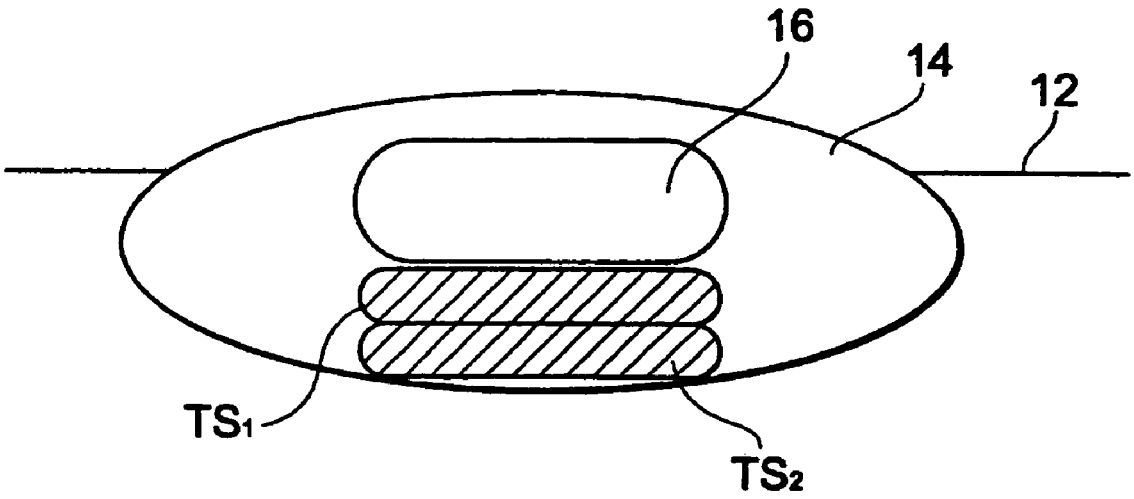
FIG. 15 is an illustration showing another sensor arrangement for detecting a lip touch value.

FIG. 15 shows another sensor arrangement for detecting a lip touch value, wherein two touch sensors $TS_1$ and $TS_2$ are arranged in parallel below the blow hole 16 in connection with the lip plate 14, thus detecting a lip touch value (or a lip's contact area) in proximity to the blow hole 16. As the touch sensors $TS_1$ and $TS_2$, it is possible to use pressure sensors or membrane sensors.

Figure 16A:
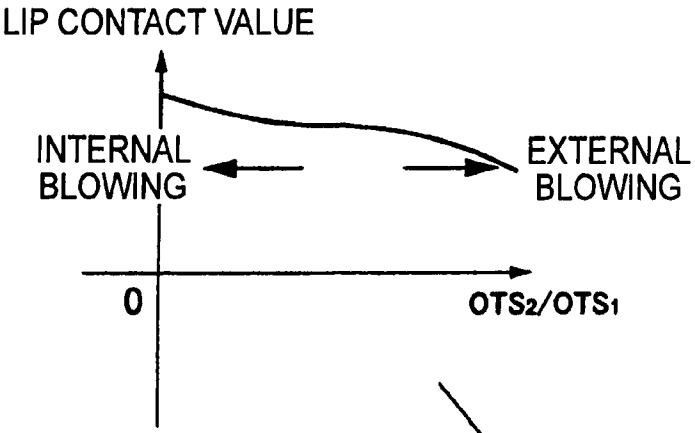
FIG. 16A shows the relationship between a ratio of $OTS_2/OTS_1$ and a lip contact value.
Figure 16B:
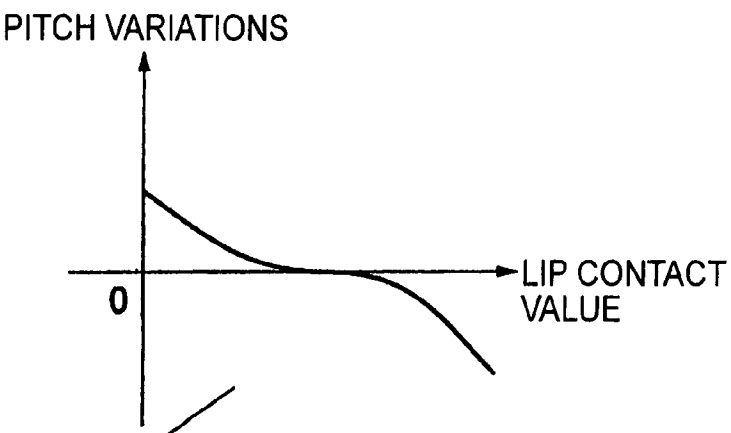
FIG. 16B shows the relationship between the lip contact value and pitch variations.
Figure 16C:
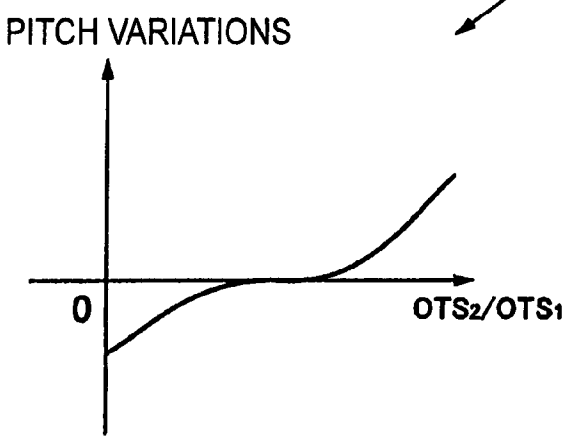
FIG. 16C shows the relationship between the ratio of $OTS_2/OTS_1$ and pitch variations.

FIG. 16A shows the relationship between a lip contact value applied to the blow hole 16 and a ratio $OTS_2/OTS_1$, which is calculated between an output $OTS_1$ of the touch sensor $TS_1$ and an output $OTS_2$ of the touch sensor $TS_2$. Herein, the ratio of $OTS_2/OTS_1$ decreases to indicate a tendency of internal blowing, while it increases to indicate a tendency of external blowing. Similar to the aforementioned graph of FIG. 11, FIG. 16B shows the relationship between the lip contact value and pitch variations. FIG. 16C shows the relationship between the ratio of $OTS_2/OTS_1$ and pitch variations on the basis of FIGS. 16A and 16B. It shows that pitches decrease as the ratio of $OTS_2/OTS_1$ decreases (so as to indicate the tendency of internal blowing), while pitches increase as the ratio of $OTS_2/OTS_1$ increases (so as to indicate the tendency of external blowing).

The ROM 24 stores pitch variation data in relation to prescribed values of the ratio of $OTS_2/OTS_1$ in accordance with FIG. 16C in the form of a pitch table, whereby pitch variation data are read from the ROM 24 in response to the detected ratio of $OTS_2/OTS_1$. Similarly to the aforementioned description regarding FIG. 11, there is introduced a mathematical expression of PC×(1.0+Pi) (where PC designates pitch control data, and Pi designates pitch variation data read from the ROM 24) so as to produce a pitch control value, which is then supplied to the tone generator 38A, thus controlling pitches of musical tone signals.

In the aforementioned descriptions regarding FIGS. 5, 8, 11 and FIGS. 14A-14C and FIGS. 16A-16C, musical tone signals are controlled in amplitude (or tone volume), tone color, and pitch with reference to the tone volume table, tone color table, and pitch table respectively. It is possible to produce tone volume variations, tone color variations, and pitch variations by way of calculations instead of readouts of the aforementioned tables.

Figure 17:
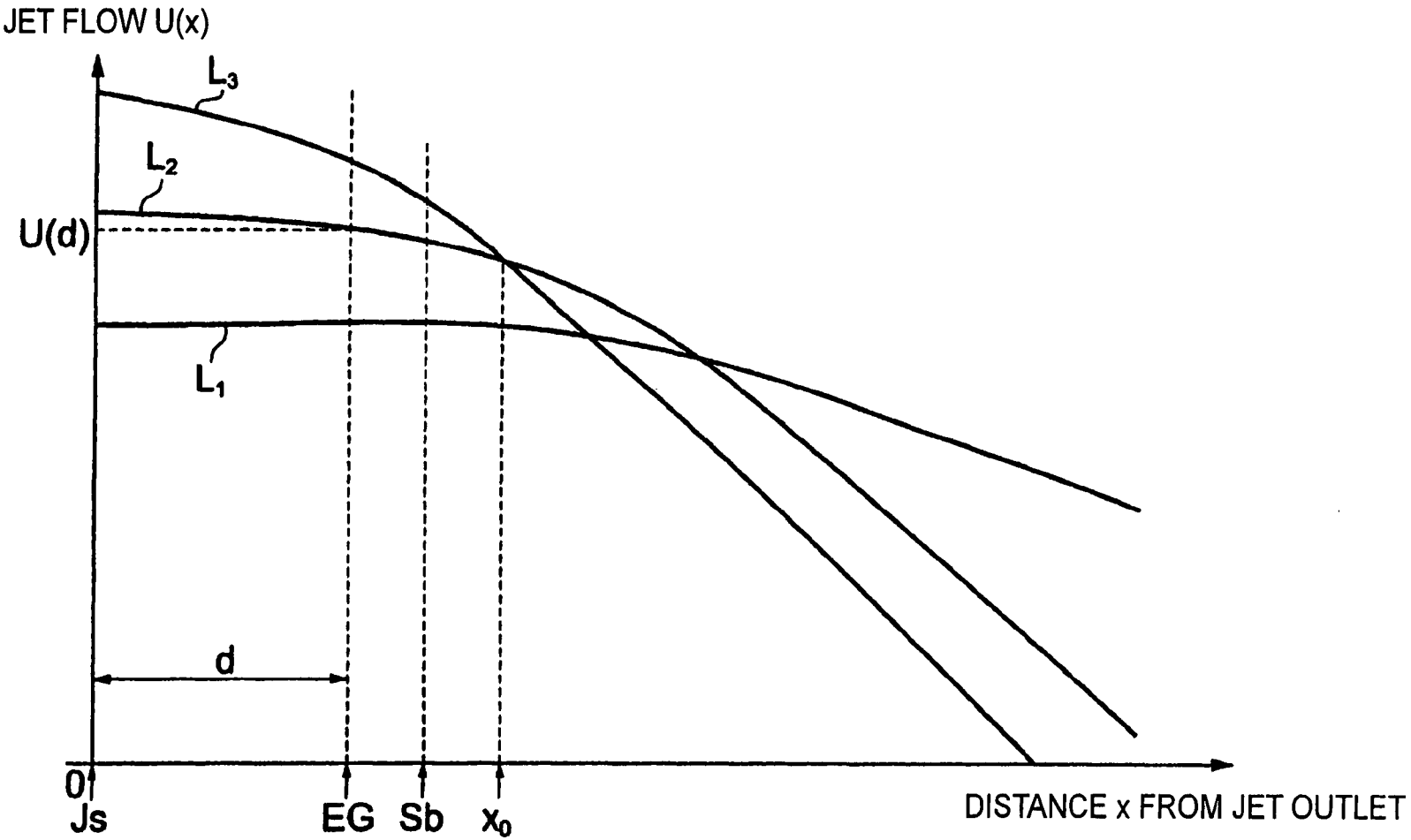
FIG. 17 shows the relationship between a distance from a jet outlet and a jet flow, which is used for explaining calculations regarding a jet transmission time.

Next, a method for calculating a jet transmission time will be described with reference to FIG. 17, in which a horizontal axis represents a distance x counted from a jet outlet, and a vertical axis represents a jet flow U(x). Curves $L_1$, $L_2$, and $L_3$ show jet flow distributions with respect to low, intermediate, and high jet initial velocities respectively. On the horizontal axis, Js represents the position of the jet outlet; EG designates the position of the edge; Sb designates the position of a flow sensor; and $x_0$ designates the intersecting point between the curves $L_2$ and $L_3$. In addition, d designates a distance between the jet outlet and the edge. As described previously in conjunction with FIG. 9, the distance d is determined based on the output of the jet length sensor Sd. In order to directly define a jet flow U(d) at the edge position, it is necessary to arrange the flow sensor Sb in the left side of the position $x_0$ (in proximity to the edge EG).

Figure 31:
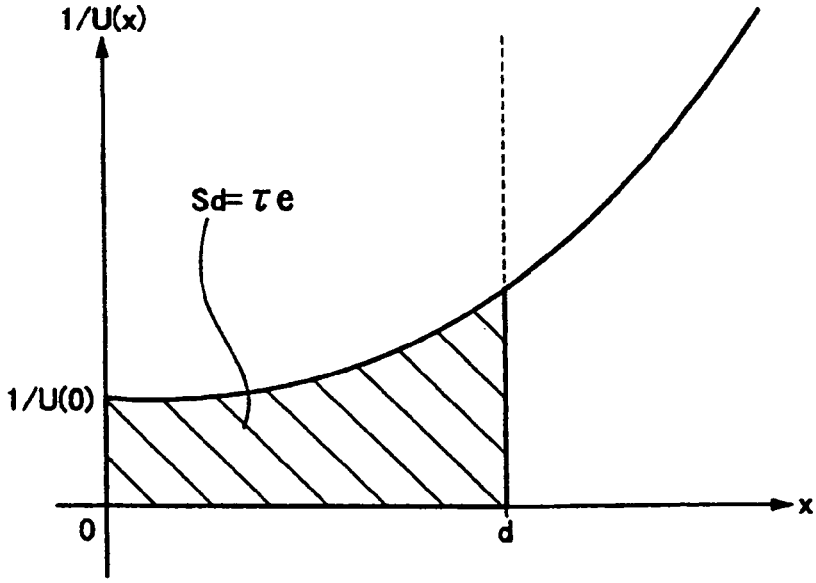
FIG. 31 is a graph for explaining calculations of a jet transmission time.

As described previously in conjunction with FIGS. 30 and 31, a plurality of flow sensors may be needed to accurately calculate the jet transmission time τe. By using the following methods ($M_1$) to ($M_4$), it is possible to accurately calculate the jet transmission time τe by use of a relatively small number of flow sensors.

($M_1$) This method provides an estimation of a jet flow distribution based on the outputs of plural flow sensors, which are arranged along a jet transmission path ranging from a jet outlet to an edge (or the proximity of an edge). For example, two flow sensors are arranged along the jet transmission path, wherein a first flow sensor is arranged at the position EG, and a second flow sensor is arranged at the position Sb shown in FIG. 17. As the first flow sensor, it is possible to use one of the horizontal sensors $S_H$ or one of the vertical sensors $S_V$ shown in FIG. 4. An interpolation method, a linear approximation, or a curve approximation is performed on the basis of the outputs of the first and second flow sensors, thus estimating a jet flow distribution as shown in the curve $L_2$. Then, the jet transmission time τe is calculated in accordance with the equation 2 or the equation 3 based on the estimated jet flow distribution and the distance d.

($M_2$) This method provides a storage of jet flow distribution data in the form of a table, wherein a single flow sensor is used and selected from among the horizontal sensors $S_H$ or the vertical sensors $S_V$ shown in FIG. 4. In addition, data regarding the jet flow distribution ranging from a jet outlet to an edge (or the proximity of an edge) are detected through actual measurement and are then stored in the ROM 24 in relation to prescribed output values of the flow sensor in the form of a table. During playing of the wind instrument controller 10 (see FIG. 1), jet flow distribution data are read from the ROM 24 in response to the output value of the flow sensor, whereby the jet transmission time $\tau e$ is calculated in accordance with the equation 2 or the equation 3 based on the jet flow distribution represented by the jet flow distribution data, which are read from the ROM 24, and the distance d.

($M_3$) This method provides a storage of jet transmission times, which are calculated in advance, in the form of a table. Herein, jet transmission times (i.e., times each required for a jet being transmitted from the jet outlet to the edge) are calculated based on the jet flow distribution and the distance d by way of the aforementioned method $M_2$, so that time data representing the calculated jet transmission times are stored in the ROM 24 in relation to prescribed output values of the flow sensor and prescribed output values of the jet length sensor in the form of a table. During playing of the wind instrument controller 10, time data are read from the ROM 24 in response to the output value of the flow sensor and the output value of the jet length sensor, so that the jet transmission time $\tau e$ is determined based on the read time data.

($M_4$) This method provides a simple equation for calculating the jet transmission time $\tau e$; that is, the jet transmission time $\tau e$ is calculated by way of a simple equation of $\tau e=d/U(d)$ (where U(d) designates the jet flow, and d designates the distance). This method is established based on a precondition in which the jet initial velocity (0) is approximately equal to the jet final velocity U(d) (where U(0)=U(d)); hence, it suits the jet flow distribution $L_1$ in which the jet initial velocity U(0) is relatively low.

Figure 18:
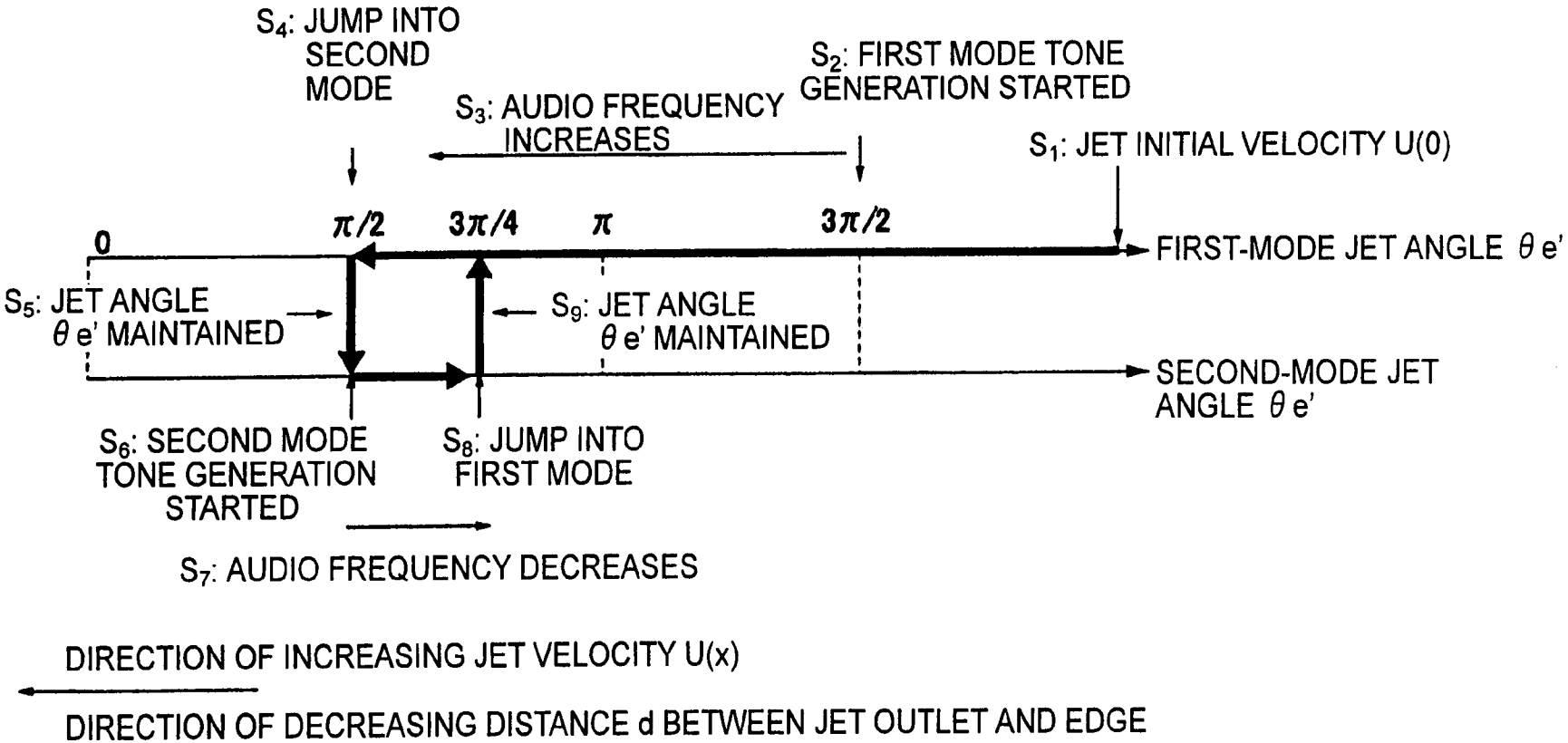
FIG. 18 is a time-related scheme regarding a mode transition diagram showing an octave changeover control operation.
Figure 32:
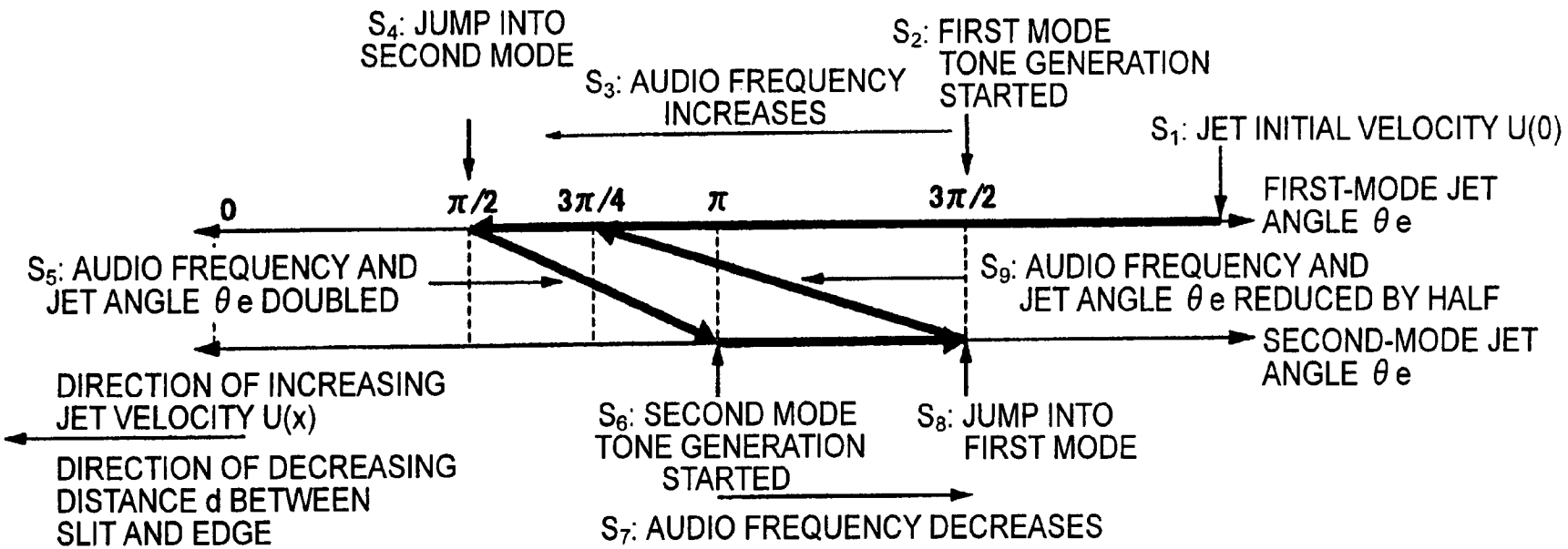
FIG. 32 is a time-related scheme regarding a mode transition diagram showing variations of octaves in an air-reed instrument.
Figure 33:
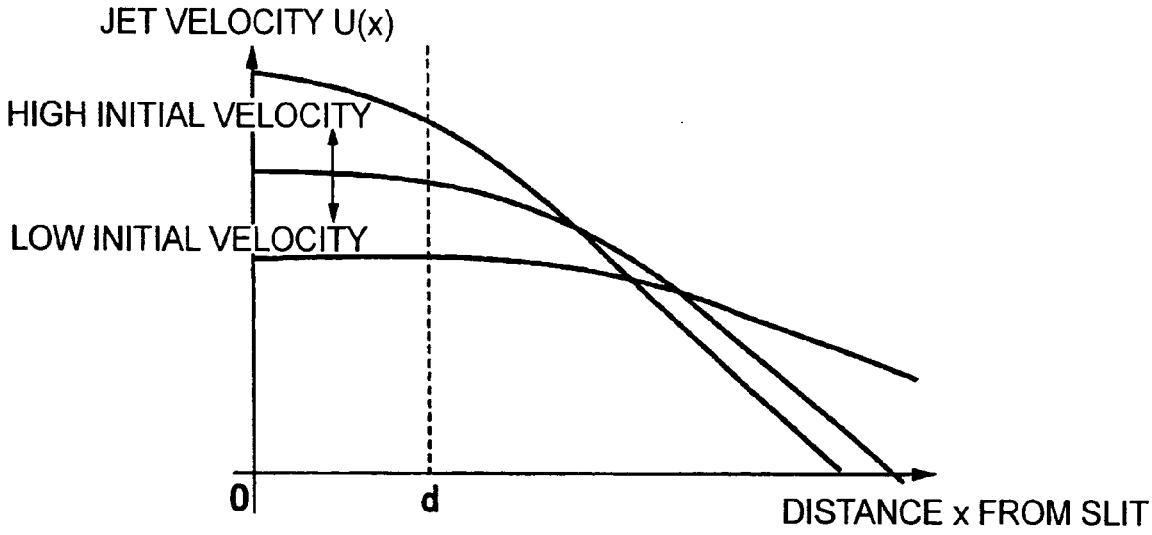
FIG. 33 is a graph showing a jet flow distribution realized in an air-reed instrument.

Similar to FIG. 32, FIG. 18 shows an octave changeover control operation of the present invention, which is illustrated in the form of a mode transition diagram. Herein, a jet angle $\theta e'$ is defined such that it is set to $\theta e$ in the first mode (similar to the foregoing operation shown in FIG. 32), but it is set to $\theta e/2$ (which is a half of the value defined in the foregoing operation shown in FIG. 32) in the second mode. In a state $S_1$, a jet occurs at a jet initial velocity U(0). In a state $S_2$ in which $\theta e'=3\pi/2$, a first mode tone generation is started. In a state $S_3$ in which the jet angle $\theta e'$ decreases in an order of $\pi$, $3\pi/4, \ldots, \pi/2$, an audio frequency is gradually increased so as to correspondingly change the tone volume and tone color. In a state $S_4$ in which $\theta e'=\pi/2$, a jump occurs from the first mode to the second mode, in which the tone pitch increases by one octave. During a state $S_5$ causing the aforementioned jump, the jet angle $\theta e'$ remains at $\pi/2$; hence, it does not require a blowing operation for doubling the jet angle $\theta e$ from $\pi/2$ to $\pi$.

In a state $S_6$ in which $\theta e'=\pi/2$, a second mode tone generation is started. In a state $S_7$ in which the jet angle $\theta e'$ increases from $\pi/2$ to $3\pi/4$, the audio frequency is gradually decreased so as to correspondingly change the tone volume and tone color. In a state $S_8$ in which $\theta e'=3\pi/4$, a jump occurs from the second mode to the first mode, in which the tone pitch decreases by one octave. In a state $S_9$ causing the aforementioned jump, the jet angle $\theta e'$ remains at $3\pi/4$; hence, it does not require a blowing operation for reducing the jet angle $\theta e'$ from $3\pi/2$ to $3\pi/4$. In FIG. 18, the left-side area is related to increasing of the jet flow U(x), wherein the distance d between the jet outlet and the edge decreases.

The octave changeover control operation shown in FIG. 18 is designed such that the jet angle $\theta e'$ in the second mode is reduced to a half (i.e., $\pi/2$, $3\pi/4$) compared with the foregoing operation shown in FIG. 32. This makes it easy to make determination regarding the start timing of the second mode tone generation and to make a decision regarding the transition from the second mode to the first mode. Incidentally, the same fingering state may be maintained even though the tone pitch increases by one octave and decreases by one octave. As the audio frequency used for the determination of the jet angle $\theta e'$, it is possible to use the audio frequency of a prescribed musical note having a prescribed octave, which should be generated by way of the same fingering state; in other words, it is unnecessary to use the actual audio frequency.

Figures 19A, 19B, 19C, 19D:
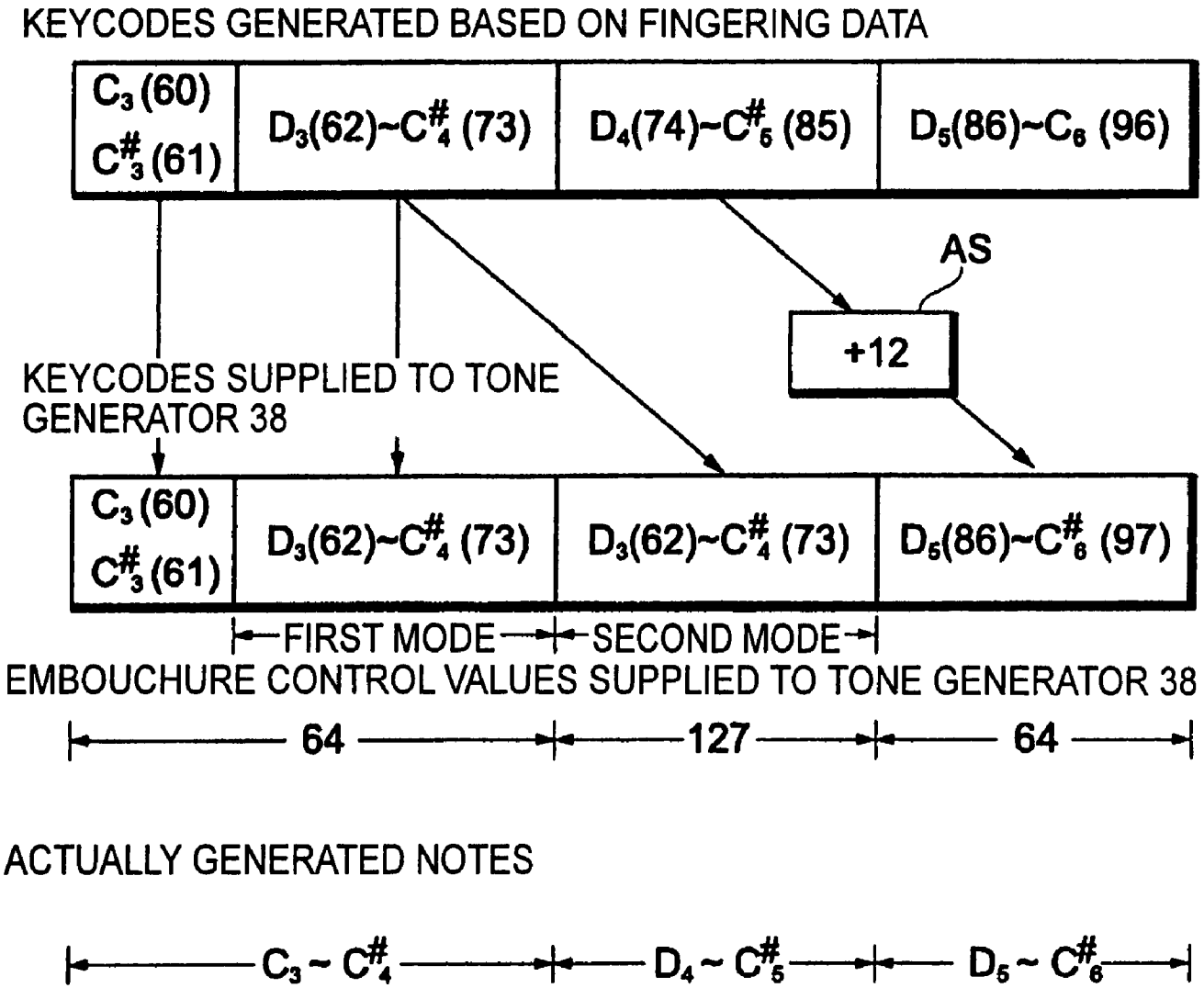
FIG. 19A shows keycodes generated based on fingering data.
FIG. 19B shows keycodes supplied to the tone generator shown in FIG. 1.
FIG. 19C shows embouchure control values supplied to the tone generator.
FIG. 19D shows notes actually generated.

FIGS. 19A to 19D show tone-generation operations based on keycodes. That is, FIG. 19A shows keycodes generated based on fingering data; FIG. 19B shows keycodes supplied to the tone generator 38; FIG. 19C shows embouchure control values supplied to the tone generator 38; and FIG. 19D shows notes actually generated. Herein, keycodes are expressed as note numbers in parenthesis.

Both of keycodes 60 and 61 are supplied to the tone generator 38 together with an embouchure control value 64 and are used to generate notes $C_3$ and $C^{\#}_3$. The embouchure control value 64 is set to the first mode with respect to keycodes 62 to 73; and an embouchure control value 127 is set to the second mode with respect to the keycodes 62 to 73. In the first mode, all the keycodes 62 to 73 are supplied to the tone generator 38 together with the embouchure control value 64 and are used to generate notes $D_3$ to $C^{\#}_4$. In the second mode, all the keycodes 62 to 73 are supplied to the tone generator 38 together with the embouchure control value 127 and are used to generate notes $D_4$ to $C^{\#}_5$.

Each of keycodes 74 or more is added with "12" by way of an addition process AS and is thus increased by one octave. For example, keycodes 74 to 85 corresponding to notes $D_4$ to $C^{\#}_5$ are respectively converted into keycodes 86 to 97 corresponding to notes $D_5$ to $C^{\#}_6$. These keycodes subjected to conversion are each supplied to the tone generator 38 together with the embouchure control value 64 and are thus used to generate a note of $D_5$ and higher notes.

Figure 20:
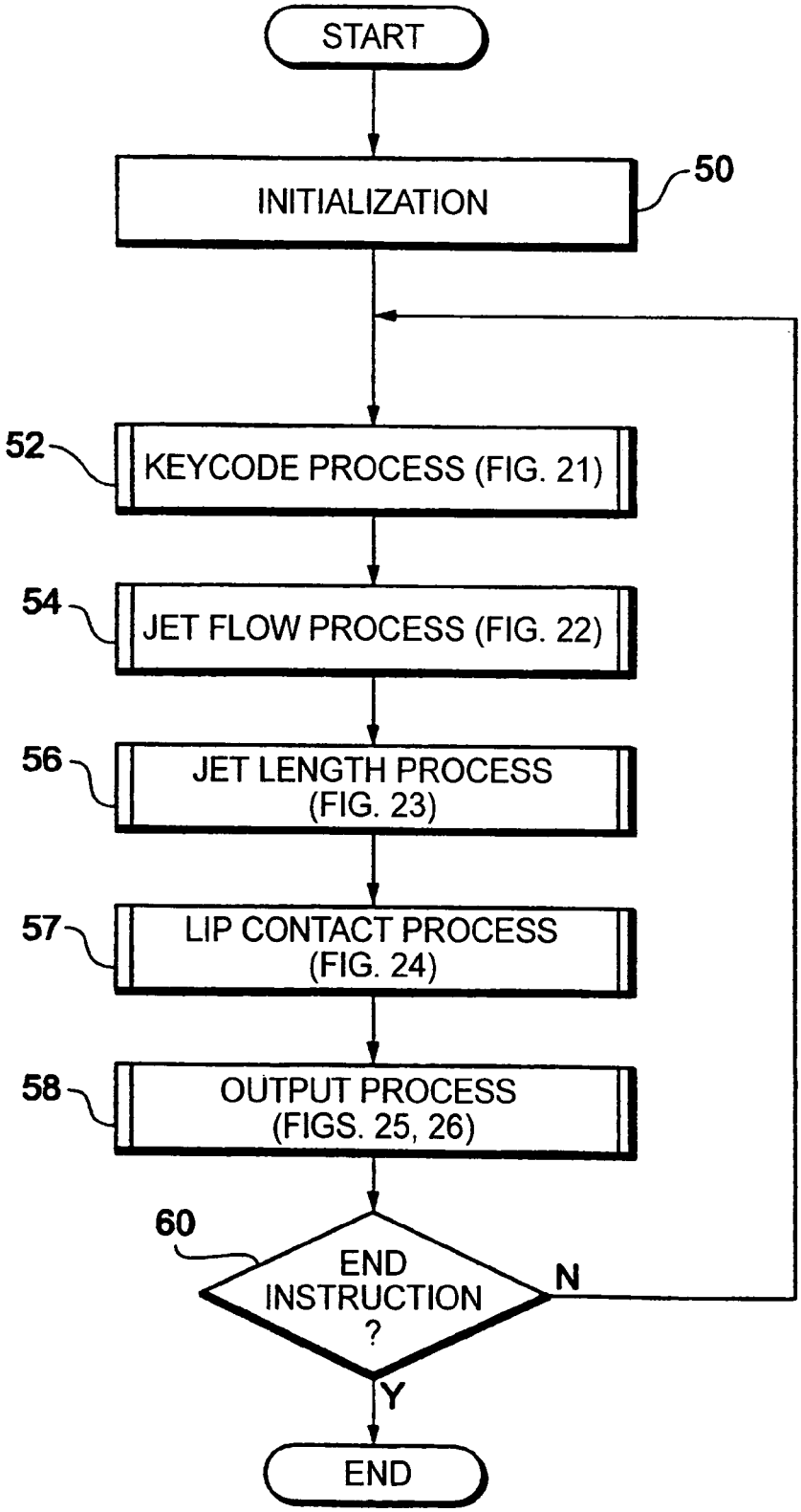
FIG. 20 is a flowchart showing a main routine.

FIG. 20 is a flowchart showing a main routine, which is started upon application of electric power. In step 50, initialization is performed. For example, all the aforementioned registers KCR, BCR, EMR, PAR, and TCR are reset to zero. In addition, zero representing a silent state is set to a mode flag MF in the RAM 26.

In step 52, a keycode process is performed based on fingering data given from the key switches 36 shown in FIG. 1, wherein the details thereof will be described later in conjunction with FIG. 21. In step 54, a jet flow process is performed based on jet flow data given from the jet flow sensor 30, wherein the details thereof will be described layer in conjunction with FIG. 22. In step 56, a jet length process is performed based on jet length data supplied from the jet length sensor 32, wherein the details thereof will be described later in conjunction with FIG. 23. In step 57, a lip contact process is performed based on lip contact data supplied from the lip contact sensor 34, wherein the details thereof will be described later in conjunction with FIG. 24. In step 58, an output process for outputting various pieces of control information to the tone generator 38 is performed, wherein the details thereof will be described later in conjunction with FIGS. 25 and 26.

After completion of the step 58, the flow proceeds to step S60 in which a decision is made as to whether or not an end instruction (e.g., a power-off event) is given. When a decision result of step 60 is NO, the flow returns to step S52. When the decision result is YES, the main routine is ended.

Figure 21:
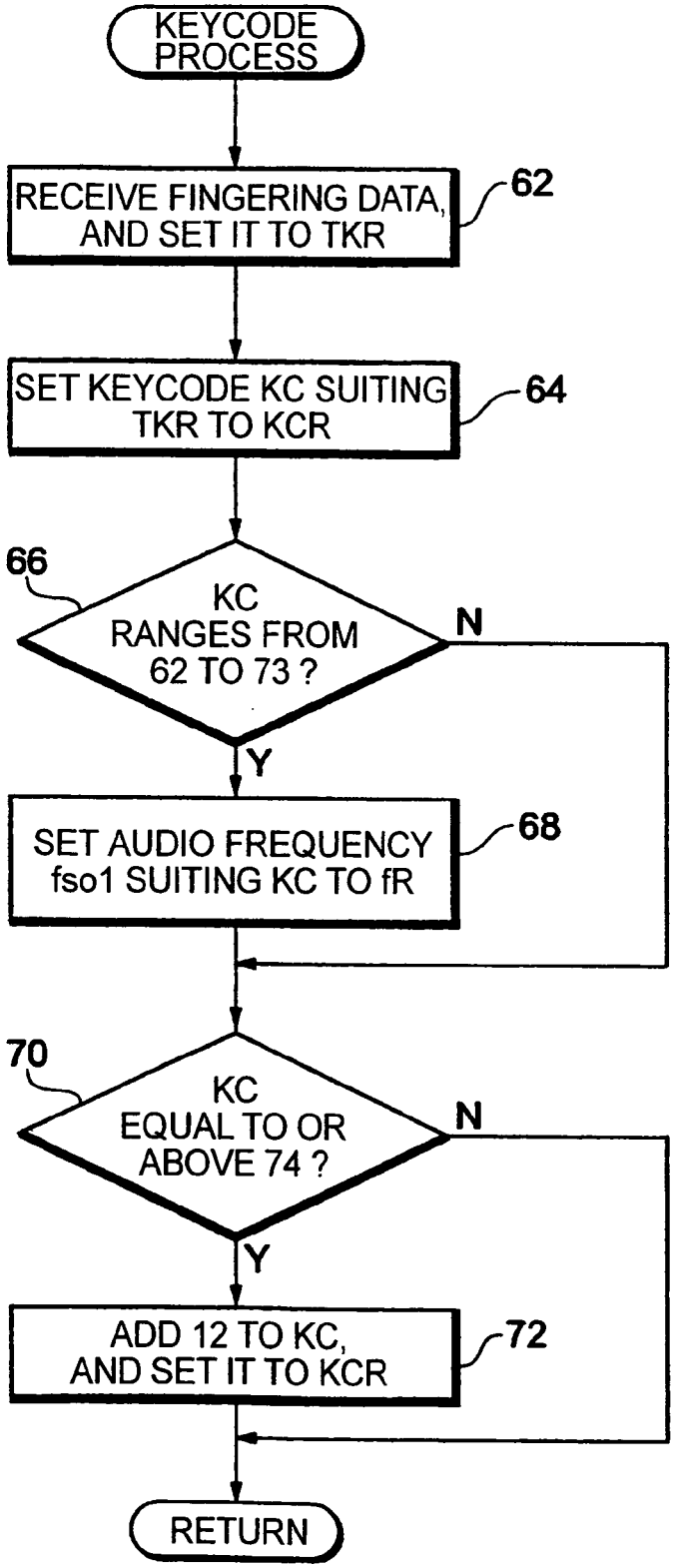
FIG. 21 is a flowchart showing a subroutine of a keycode process.

FIG. 21 shows a subroutine of a keycode process. In step 62, fingering data are received from the keycode switches 36 and are then set to a register TKR of the RAM 26. The ROM 24 stores in advance a keycode table in which keycodes are stored in relation to fingering states of fingering data as shown in FIG. 19A. In step 64, a keycode KC is read from the keycode table of the ROM 24 in response to the fingering data presently set to the register TKR and is then set to a register KCR.

In step 66, a decision is made as to whether or not the keycode KC presently set to the register KCR belongs to a prescribed range of values, i.e., 62-73 (corresponding to $D_3$ to $C^{\#}_4$), in relation to the first and second modes. The ROM 24 stores in advance a frequency table showing frequencies of musical tone signals corresponding to prescribed notes belonging to prescribed octaves in relation to prescribed values of keycodes. When a decision result of step 66 is YES, it is determined that the user's operation applied to the wind instrument controller 10 is related to the first and second modes. Hence, the flow proceeds to step 68 in which a frequency fso1 is read from the frequency table of the ROM 24 in response to the keycode KC presently set to the register KCR, so that the corresponding frequency data (representing fso1) is set to a register fR of the RAM 26.

When the decision result of step 66 is NO (indicating that the user's operation applied to the wind instrument controller 10 is related to another mode other than the first and second modes), or when the step 68 is completed, the flow proceeds to step 70 in which a decision is made as to whether or not the keycode KC presently set to the register KCR is equal to or above "74" (i.e., $D_4$). When a decision result of step 70 is YES, the flow proceeds to step 72 in which "12" is added to the keycode KC of the register KCR, so that the addition result is set to the register KCR. This step 72 realizes the aforementioned addition process AS shown in FIG. 19A. After completion of the step 72, or when the decision result of step 70 is NO, the flow returns to the main routine shown in FIG. 20.

Figure 22:
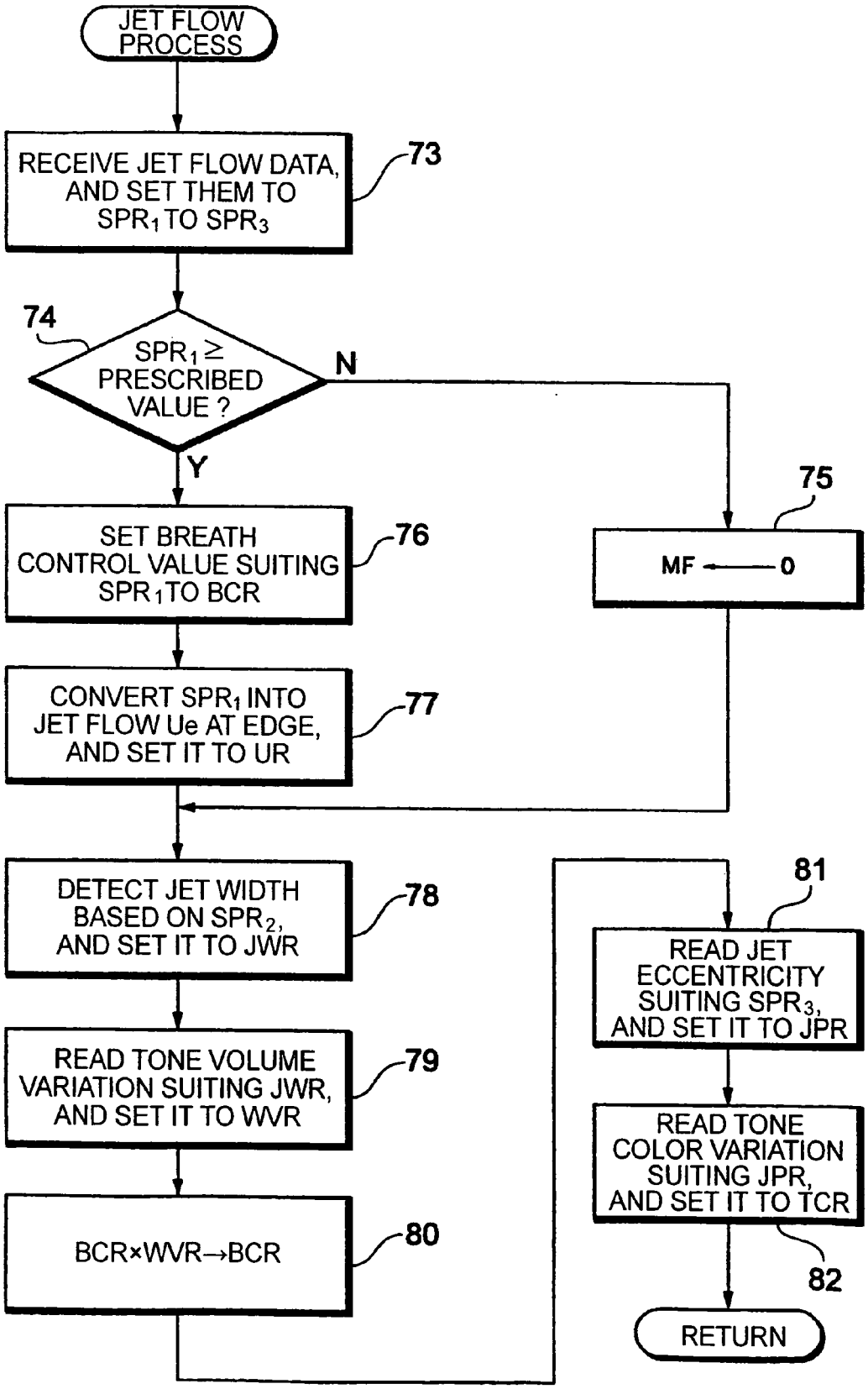
FIG. 22 is a flowchart showing a subroutine of a jet flow process.

FIG. 22 shows a subroutine of a jet flow process. In step 73, jet flow data are received from the jet flow sensor 30 and are set to registers $SPR_1$ to $SPR_3$ in the RAM 26. Specifically, jet flow data output from a single flow sensor arranged at the center of the horizontal sensors $S_H$ or at the center of the vertical sensors $S_V$. Alternatively, it is possible to average plural jet flow data output from plural flow sensors (e.g., two flow sensors), which are arranged in proximity to the center of the horizontal sensors $S_H$ or in proximity to the center of the vertical sensors $S_V$, thus producing average jet flow data, which is then set to the register $SPR_1$. Jet flow data output from the flow sensors corresponding to the horizontal sensors $S_H$ are set to the register $SPR_2$. Jet flow data output from the flow sensors corresponding to the vertical sensors $S_V$ are set to the register $SPR_3$. In step 74, a decision is made as to whether or not the jet flow data presently set to the register $SPR_1$ is equal to or above a prescribed value, which is an appropriate value enabling tone generation. When a decision result of step 74 is NO, the flow proceeds to step 75 in which zero (representing a silent state) is set to a mode flag MF.

When the decision result of step 74 is YES, the flow proceeds to step 76. The ROM 24 stores in advance a breath table showing breath control values in relation to prescribed values of jet flow data. In step 76, a breath control value is read from the breath table of the ROM 24 in response to the jet flow data presently set to the register $SPR_1$ and is then set to a register BCR. The ROM 24 stores in advance a jet flow table showing various values regarding a jet flow Ue (corresponding to the aforementioned jet flow U(d) shown in FIG. 17) at the edge EG in relation to prescribed values of jet flow data. In step 77, the jet flow data of the register $SPR_1$ is converted into the jet flow Ue with reference to the jet flow table of the ROM 24, so that jet flow data representing the jet flow Ue is set to a register UR of the RAM 26.

After completion of the step 75 or after completion of the step 77, the flow proceeds to step 78 in which a jet width is detected based on the jet flow data presently set to the register $SPR_2$ and is then set to a register JWR of the RAM 26. In step 79, a tone volume variation is read from the aforementioned tone volume table of the ROM 24 in response to the jet flow presently set to the register JWR and is then set to a register WVR of the RAM 26. In step 80, the breath control value of the register BCR is multiplied by the tone volume variation of the register WVR so as to produce a multiplication result, which is then set to the register BCR as a tone volume control value. In step 81, a jet eccentricity is detected based on the jet flow data presently set to the register $SPR_3$ and is then set to a register JPR of the RAM 26. In step 82, a tone color variation (i.e., an offset value of a read address) is read from the aforementioned tone color table of the ROM 24 in response to the jet eccentricity of the register JPR and is then set to a register TCR as a tone color control value. After completion of the step 82, the flow returns to the main routine shown in FIG. 20. The step 81 can be modified such that, instead of the jet eccentricity, the jet thickness (which was previously described in conjunction with FIG. 7) is detected and is then set to the register JPR. In this case, the ROM 24 stores in advance a tone color table showing pitch variations in relation to prescribed values of the jet thickness; hence, in step 82, a tone color variation is read from the tone color table in response to the jet thickness and is then set to the register TCR.

Figure 23:
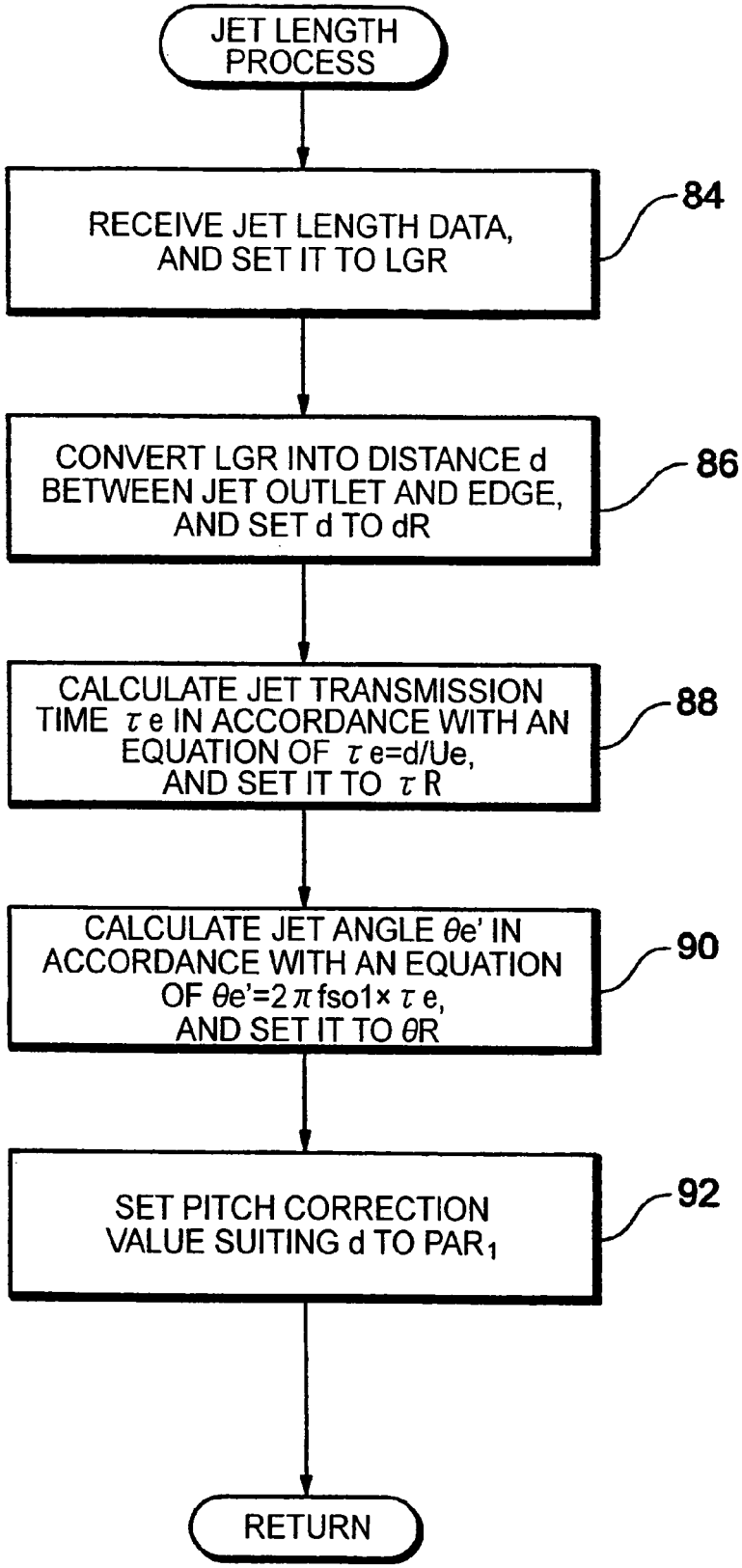
FIG. 23 is a flowchart showing a subroutine of a jet length process.

FIG. 23 shows a subroutine of a jet length process. In step 84, jet length data is received from the jet length sensor 32 and is then set to a register LGR of the RAM 26. The ROM 24 stores in advance a distance table showing prescribed values of the distance d between the jet outlet and edge in relation to prescribed values of jet length data. In step 86, the jet length data presently set to the register LGR is converted into the distance d with reference to the distance table of the ROM 24, so that the corresponding distance data (representing the distance d) is set to a register dR of the RAM 26.

Next, the flow proceeds to step 88 in which a jet transmission time $\tau e$ is calculated in accordance with an equation of $\tau e = d/Ue$ by use of the jet flow Ue represented by the jet flow data of the register UR and the distance d represented by the distance data of the register dR, so that the corresponding time data (representing the jet transmission time $\tau e$) is set to a register $\tau R$ of the RAM 26. In step 88, the aforementioned method ($M_4$) expressing a simple calculation for the jet transmission time $\tau e$ is selected from among the methods ($M_1$) to ($M_4$). Of course, it is possible to use any one of the methods ($M_1$) to ($M_3$) so as to calculate the jet transmission time $\tau e$.

In step 90, a jet angle $\theta e'$ is calculated in accordance with an equation of $\theta e' = 2\pi fso1 \times \tau e$ by use of the jet transmission time $\tau e$ represented by the time data of the register $\tau R$ and the frequency fso1 represented by the frequency data of the register fR, so that the corresponding jet angle data (representing the jet angle $\theta e'$) is set to a register $\theta R$ of the RAM 26. The ROM 24 stores in advance a pitch table showing pitch correction values in relation to prescribed values of the distance d (which is detected in step 86). In step 92, a pitch correction value is read from the pitch table of the ROM 24 in response to the distance d represented by the distance data of the register dR and is then set to a register $PAR_1$ of the RAM 26. Thereafter, the flow returns to the main routine shown in FIG. 20.

Figure 24:
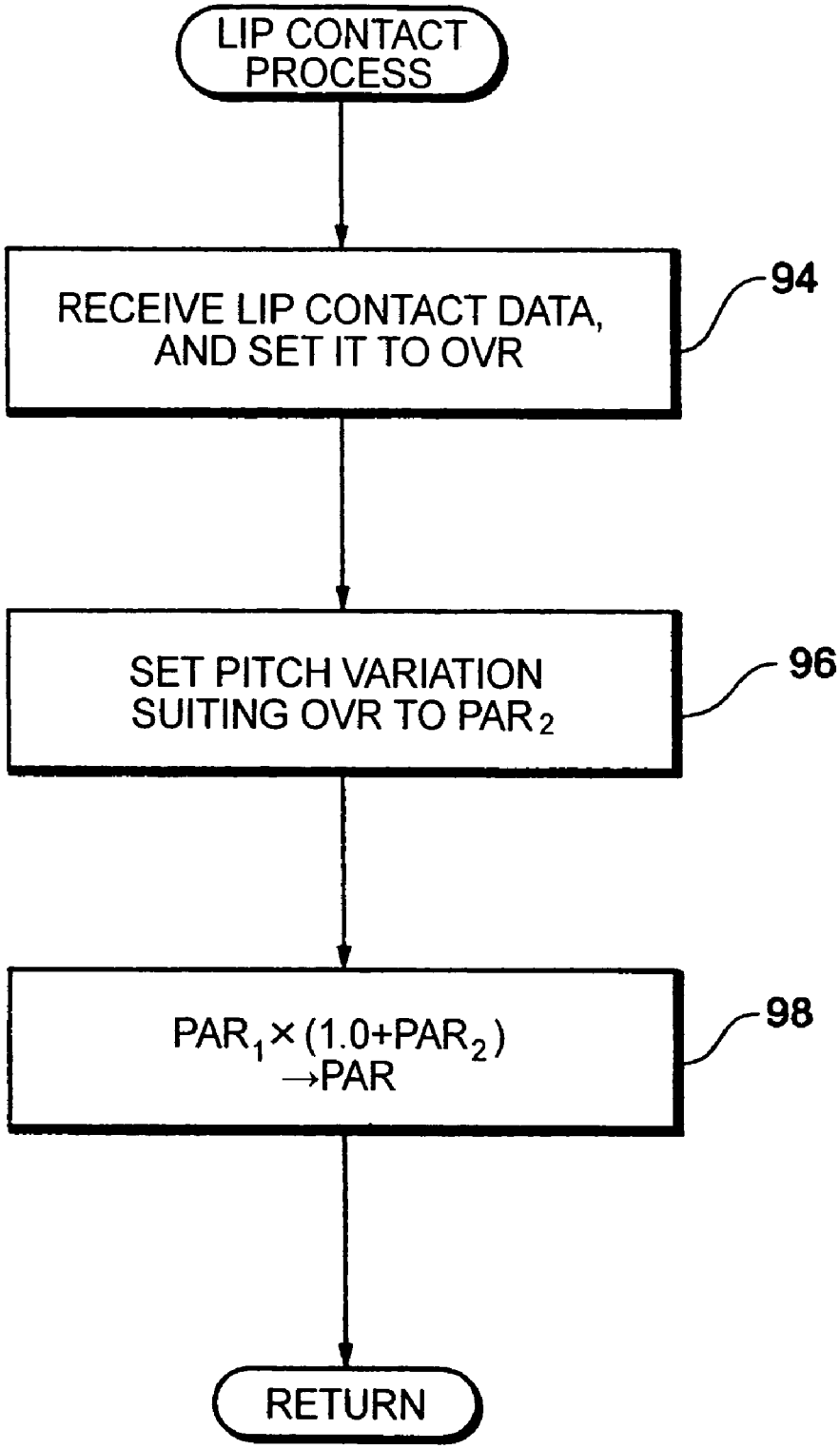
FIG. 24 is a flowchart showing a subroutine of a lip contact process.

FIG. 24 shows a subroutine of a lip contact process. In step 94, lip contact data is received from the lip contact sensor 34 and is then set to a register OVR of the RAM 26.

In step 96, a pitch variation is read from the pitch table of the ROM 24 in response to the lip contact data of the register OVR and is then set to a register $PAR_2$. In step 98, the pitch variation of the register $PAR_2$ is added with "1.0" and is then multiplied by the pitch correction value of the register PAR, so as to produce a pitch control value, which is set to a register PAR. After completion of the step 98, the flow returns to the main routine shown in FIG. 20.

The step 94 can be modified such that, instead of the lip contact data, lip touch data is detected on the basis of the aforementioned sensor arrangement shown in FIG. 13 or FIG. 15 and is then set to the register OVR. In this case, in step 96, a pitch variation is read from the aforementioned pitch table of the ROM 24 shown in FIG. 14C or FIG. 16C in response to the lip touch data of the register OVR and is then set to the register $PAR_2$. Incidentally, the step 98 is performed without changes.

Figure 25:
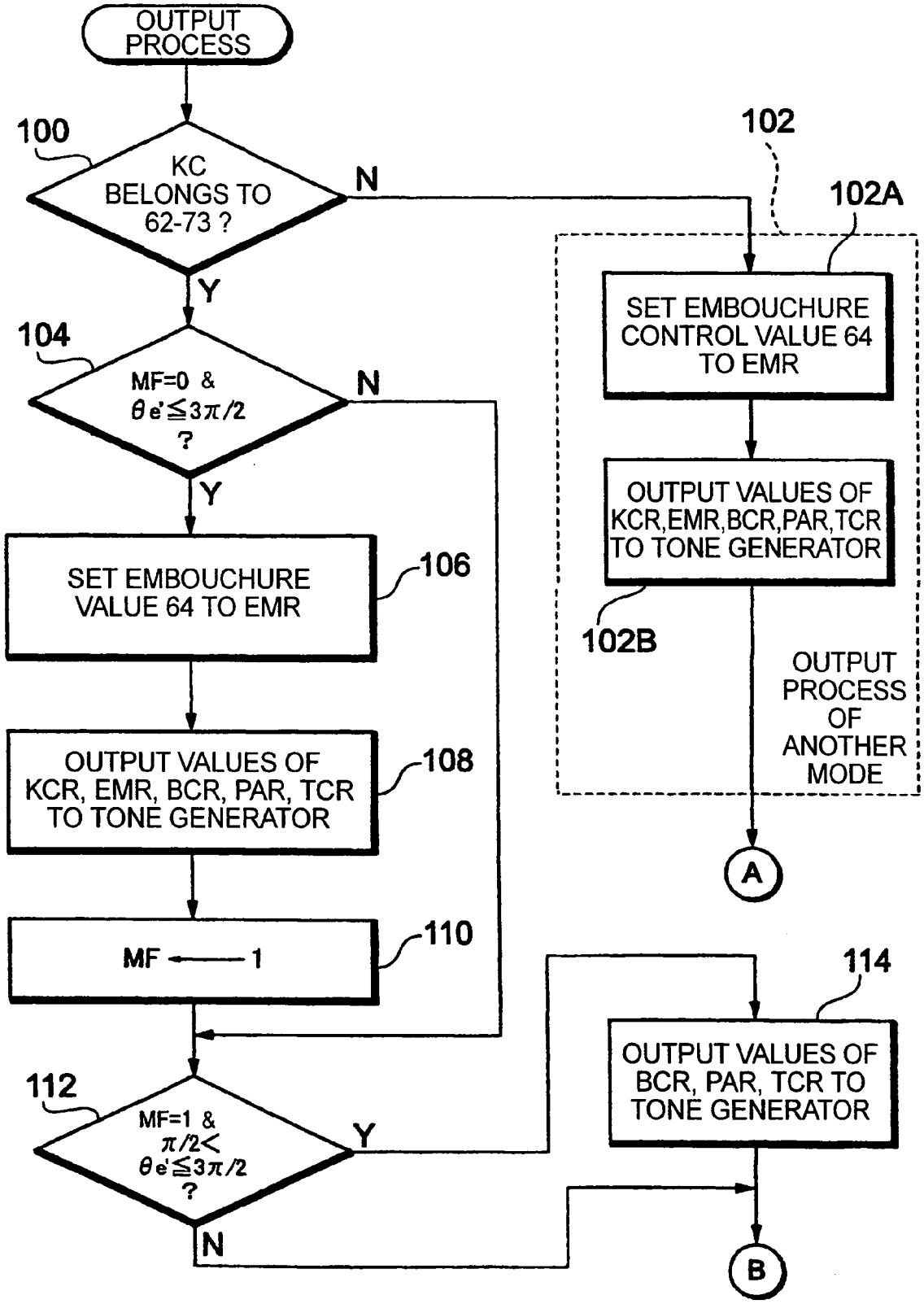
FIG. 25 is a flowchart showing a first part of a subroutine of an output process.
Figure 26:
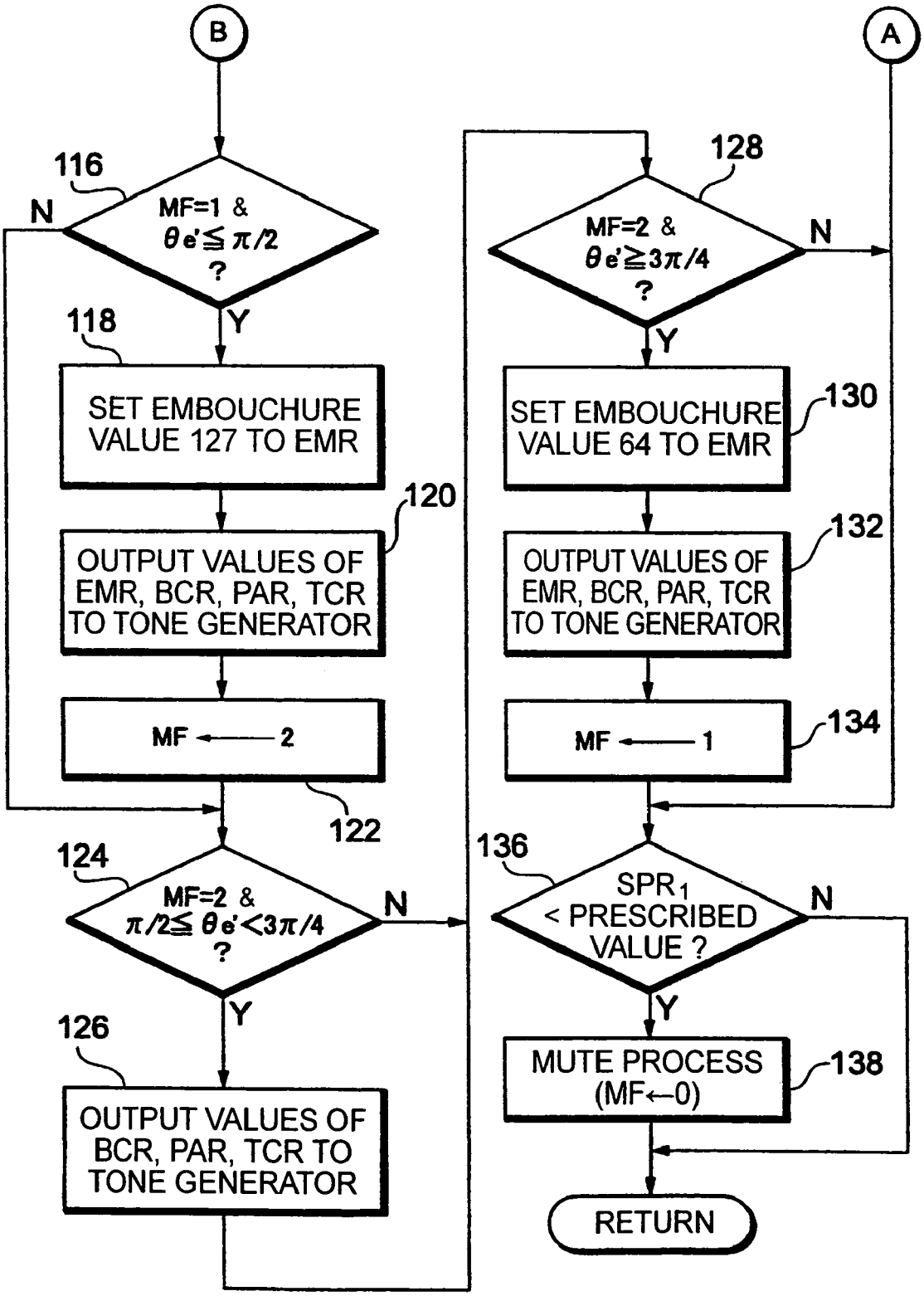
FIG. 26 is a flowchart showing a second part of the subroutine of the output process.

FIGS. 25 and 26 show a subroutine of an output process. In step 100, a decision is made as to whether or not the keycode KC presently set to the register KCR belongs to a range of prescribed values, i.e., 62-73, in relation to the first and second modes. When a decision result of step 100 is NO, it is presumed that the keycode KC is set to 60 or 61 or above 74 (indicating another mode other than the first and second modes); hence, the flow proceeds to step 102 in which an output process is performed with respect to another mode.

In step 102A, an embouchure control value "64" is set to a register EMR. In step 102B, all the keycode KC of the register KCR, the embouchure control value of the register EMR, the tone volume control value of the register BCR, the pitch control value of the register PAR, and the tone color control value of the register TCR are supplied to the tone generator 38. As a result, the sound system 42 generates a musical tone whose keycode is set to 60 or 61 or above 74, wherein the tone volume, pitch, and tone color of the musical tone are controlled in response to the tone volume control value, pitch control value, and tone color control value respectively.

After completion of the output process of another mode in step 102, the flow proceeds to step 136 shown in FIG. 26. In step 136, a decision is made as to whether or not the jet flow data of the register $SPR_1$ is smaller than a prescribed value, which is described in step 74 shown in FIG. 22. When a decision result of step 136 is NO, the flow returns to the main routine shown in FIG. 20. When the decision result of step 136 is YES, the flow proceeds to step 138 in which a mute process is performed such that all control inputs applied to the physical-model tone generator 38A are reset to zero; zero is set to all of the registers KCR, BCR, EMR, PAR, and TCR; and the mode flag MF is set to zero (indicating a silent state). As a result, a musical tone presently being generated starts to be attenuated, thus allowing a new musical tone to be generated. After completion of step 138, the flow returns to the main routine shown in FIG. 20.

When the decision result of step 100 is YES (indicating that the user's operation applied to the wind instrument controller 10 is related to the first and second modes), the flow proceeds to step 104 in which a decision is made as to whether or not the mode flag MF is set to zero and the jet angle θe' is reduced to $3\pi/2$. When the decision result of step 104 is YES, the flow proceeds to step 106 in which an embouchure value "64" is set to the register EMR.

In step 108 (which is similar to the foregoing step 102B), the values presently set to the registers KCR, EMR, BCR, PAR, and TCR are supplied to the tone generator 38. As a result, when the jet angle θe' is reduced to reach $3\pi/2$ in the silent state, a musical tone corresponding to any one of notes $D_3$ to $C^{\#}_4$ is generated, wherein the tone volume, pitch, and tone color of the musical tone are controlled in response to the tone volume control value, pitch control value, and tone color control value respectively. Then, "1" (representing the first mode) is set to the mode flag MF.

After completion of step 110, or when the decision result of step 104 is NO, the flow proceeds to step 112 in which a decision is made as to whether or not the mode flag MF is set to "1" and the jet angle θe' ranges from $\pi/2$ to $3\pi/2$. When a decision result of step 112 is YES, the flow proceeds to step 114 in which the tone volume control value of the register BCR, the pitch control value of the register PAR, and the tone color control value of the register TCR are supplied to the tone generator 38. As a result, when the jet angle θe' belongs to the range defined as $\pi/2<\theta e'\leqq 3\pi/2$ (see FIG. 18), it is possible to gradually increase the audio frequency or change the tone volume and/or tone color by increasing the jet flow and by decreasing the distance d.

Figure 27:
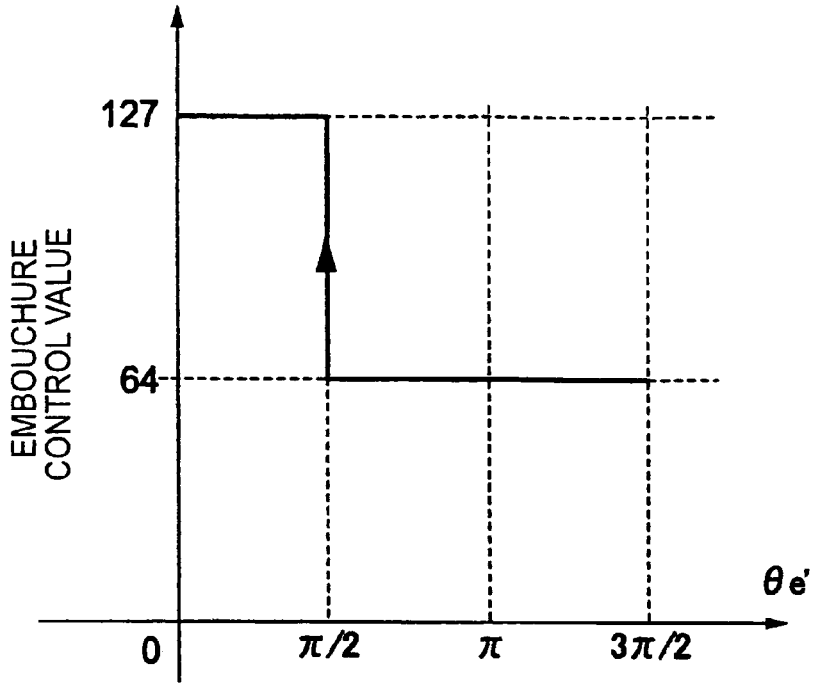
FIG. 27 is a graph showing the relationship between a jet angle and an embouchure control value in an octave ascending mode.

After completion of step 114, or when the decision result of step 112 is NO, the flow proceeds to step 116 in which a decision is made as to whether or not the mode flag MF is set to "1" and the jet angle θe' is decreased to $\pi/2$. When a decision result of step 116 is YES, the flow proceeds to step 118 in which an embouchure control value "127" is set to the register EMR. As shown in FIG. 27, the embouchure control value increases from "64" to "127" when the jet angle θe' reaches $\pi/2$. When the decision result of step 116 is NO, the flow proceeds to step 124.

In step 120, all of the embouchure control value of the register EMR, the tone volume control value of the register BCR, the pitch control value of the register PAR, and the tone color control value of the register TCR are supplied to the tone generator 38. As a result, in the state $S_4$ shown in FIG. 18, a jump occurs from the first mode to the second mode, thus increasing the tone pitch by one octave. Herein, the tone volume, pitch, and tone color of a musical tone are controlled in response to the tone volume control value, pitch control value, and tone color control value respectively. Then, the flow proceeds to step 122 in which the mode flag MF is set to "2" (indicating the second mode).

Next, in step 124, a decision is made as to whether or not the mode flag MF is set to "2" and the jet angle θe' ranges from $\pi/2$ to $3\pi/4$. When a decision result of step 124 is YES, the flow proceeds to step 126 in which, similar to the aforementioned step 114, the values presently set to the registers BCR, PAR, and TCR are supplied to the tone generator 38. As a result, it is possible to gradually decrease the audio frequency and to change the tone volume and/or tone color by reducing the jet flow velocity and by increasing the distance d in the condition where $\pi/2\leqq\theta e'<3\pi/4$ (see FIG. 18).

Figure 28:
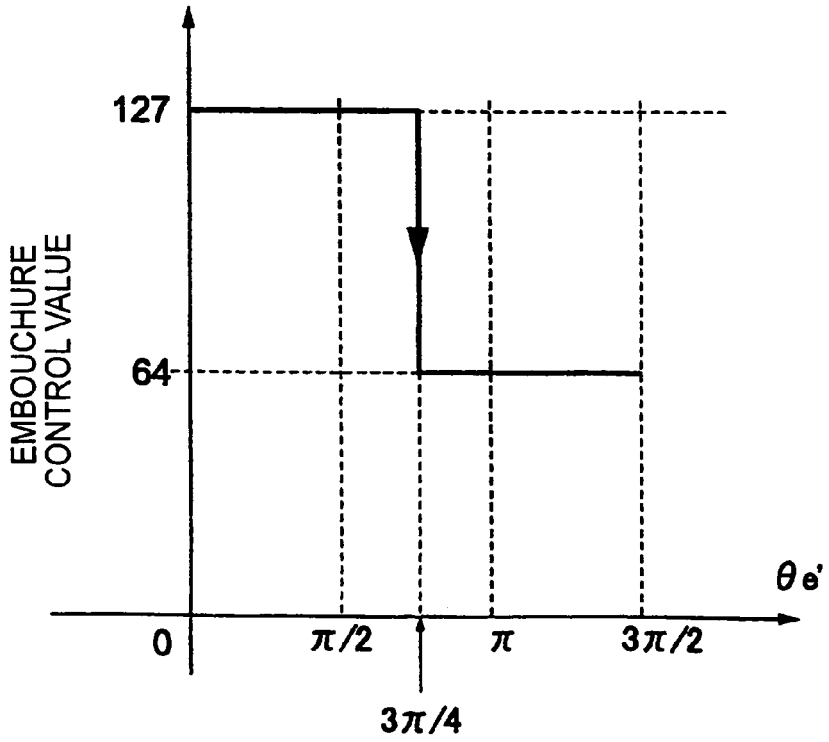
FIG. 28 is a graph showing the relationship between a jet angle and an embouchure control value in an octave descending mode.

After completion of step 126, or when the decision result of step 124 is NO, the flow proceeds to step 128 in which a decision is made as to whether or not the mode flag MF is set to "2" and the jet angle θe' is increased to reach $3\pi/4$. When a decision result of step 128 is YES, the flow proceeds to step 130 in which an embouchure control value "64" is set to the register EMR. As shown in FIG. 28, the embouchure control value decreases from "127" to "64" when the jet angle θe' is increased to reach $3\pi/4$.

In step 132 (similar to the aforementioned step 120), the values presently set to the registers EMR, BCR, PAR, and TCR are supplied to the tone generator 38. As a result, in the state $S_8$ shown in FIG. 18, a jump occurs from the second mode to the first mode, thus decreasing the tone pitch by one octave. In addition, the tone volume, pitch, and tone color of a musical tone are controlled in response to the tone volume control value, pitch control value, and tone color control value respectively. Then, the flow proceeds to step 134 in which the mode register MF is set to "1".

In step 136, a decision is made as to whether or not the jet flow data of the register $SPR_1$ is smaller than the prescribed value. When a decision result of step 136 is YES, the flow proceeds to step 138 in which a mute process is performed. After completion of step 138, the flow returns to the main routine shown in FIG. 20.

In the present embodiment described above, the jet angle θe' is used as a jet parameter in the aforementioned decision steps 104, 112, 116, 124, and 128, wherein it is compared with a certain value including π(e.g., 3π/2). As the jet parameter, it is possible to use another value not including π (e.g., 2fso1×τe) and to use another reference value not including π (e.g., 3/2) in comparison.

The present embodiment enables an electronic wind instrument to perform an octave-changeover-blowing technique in which two notes, which have the same tone pitch but differ from each other by an octave, can be easily produced respectively with the same fingering state by slightly changing the jet flow Ue and the distance d. When no hysteresis characteristics are introduced into an octave changeover event, octave variations may easily occur in specific executions such as vibrato, which may cause difficulty in playing. The present embodiment introduces hysteresis characteristics into an octave changeover event; hence, as long as the jet angle θe' belongs to the aforementioned ranges of $\pi/2<\theta e'\leqq 3\pi/4$ and $\pi/2\leqq\theta e'<3\pi/4$, it is possible to realize specific executions such as pitch bending and vibrato. When a user plays an electronic wind instrument by way of a tonguing technique (in which blowing is started after temporarily stopping breath with the tongue) instead of a slur technique (in which fingering is changed by a blowing state) so as to produce a note of one octave higher, blowing is performed by way of weak breathing, which in turn temporarily causes a note of one octave lower in the attack and release portions of a musical tone waveform. The present embodiment copes with such a difficulty, which may occur when playing a flute. In addition, the present embodiment is characterized in that the tone volume is controlled in response to the jet width; the tone color is controlled in response to the jet eccentricity; the tone volume is also controlled in response to the jet thickness; and the tone pitch is controlled in response to the lip contact value or the lip touch value applied to the proximity of the blow hole. This realizes rich musical performance in terms of the tone volume, pitch, and tone color. In short, the present embodiment is capable of coping with embouchures caused by various playing methods of flutes. That is, the present embodiment is preferably suited to users who would like to enjoy playing flutes and the like.

When the waveform-table tone generator 38B shown in FIG. 3 is used for the tone generator 38 shown in FIG. 1, it is necessary to provide conversion circuits 160, 162, 164, and 166. The conversion circuit 160 directly supplies any one of keycodes KC ranging from "60" to "73" or above "86" (see FIGS. 19A and 19B) to the pitch control input of the tone generator 38B when the embouchure control value "64" is set to the register EMR (see FIG. 19C); and it adds "12" to any one of keycodes KC ranging from "62" to "73" so as to produce any one of keycodes KC ranging from "74" to "85", each of which is then supplied to the pitch control input of the tone generator 38B when the embouchure control value "127" is set to the register EMR. Herein, the tone generator 38B generates musical tone signals whose notes range from $D_4$ to $C^{\#}_5$ based on the keycodes KC ranging from "74" to "85" respectively.

The conversion circuit 162 converts the tone volume control value of the register BCR into tone volume control information, which is then supplied to the tone volume control input of the tone generator 38B. The conversion circuit 164 converts the pitch control value of the register PAR into pitch control information, which is then supplied to the pitch control input of the tone generator 38B. The conversion circuit 166 converts the tone color control value of the register TCR into the tone color control information, which is then supplied to the tone color control input of the tone generator 38B. Incidentally, the conversion processing corresponding to the aforementioned functions of the conversion circuits 160 to 166 can be realized on a computer. It is not necessary to use the conversion processing of the conversion circuits 160 to 166; in this case, various pieces of control information corresponding to the outputs of the conversion circuits 160 to 166 can be produced by a computer and are then supplied to the tone generator 38B.

The tone generator 38B is supplied with note-on information NTON (for starting generation of a musical tone) and note-off information NTOF (for starting attenuation of a musical tone). Herein, the note-on information NTON can be produced by way of the aforementioned decision step 74 shown in FIG. 22; and the note-off information NTOF can be produced by way of the aforementioned decision step 136 shown in FIG. 26.

Lastly, the present invention is not necessarily limited to the aforementioned embodiment and its variations; hence, it is possible to provide further variations within the scope of the invention as defined in the appended claims.

What is claimed is:

1. A tone control device adapted to an electronic wind instrument having a tube, a lip plate having a blow hole, a plurality of tone keys, and a tone generator, said tone control device comprising:

a jet flow sensing means for detecting a velocity or strength of a jet flow, which is caused by blowing air into the blow hole and is transmitted so as to collide with an edge, wherein a jet width is detected based on the output of the jet flow sensing means including a plurality of flow sensors horizontally arranged with respect to the edge;

a jet length sensing means for detecting a jet length within a range between the lip plate and the edge;

a jet transmission time detection means for detecting a jet transmission time in which a jet travels from a jet outlet in proximity to the blow hole to the edge on the basis of the output of the jet flow sensing means and the output of the jet length sensing means;

a fingering state detection means for detecting a fingering state based on operated states of the tone keys;

an audio frequency designation means for designating an audio frequency realizing a desired note and a desired octave based on the fingering state;

a jet angle calculation means for calculating a jet angle by way of a multiplication using the audio frequency and the jet transmission time; and a tone generator control means for controlling the tone generator in terms of an amplitude and a tone pitch of a musical tone signal based on the output of the jet flow sensing means, wherein the tone generator control means controls the musical tone signal so as to be increased in tone pitch by one octave when the jet angle belongs to a first range, and the tone generator control means controls the musical tone signal so as to be decreased in tone pitch by one octave when the jet angle belongs to a second range higher than the first range during generation of the musical tone signal whose tone pitch is once increased by one octave.

2. A computer-readable medium containing a computer program for performing a tone control method adapted to an electronic wind instrument which includes a tube, a lip plate having a blow hole, a plurality of tone keys, and a tone generator, and which is equipped with a jet flow sensing means for detecting a velocity or intensity of a jet flow, which is caused by blowing air into the blow hole and is transmitted so as to collide with an edge, so that a jet width is detected based on the output of the jet flow sensing means including a plurality of flow sensors horizontally arranged with respect to the edge, and a jet length sensing means for detecting a jet length within a range between the lip plate and the edge, said tone control method comprising the steps of:

detecting a jet transmission time in which a jet travels from a jet outlet in proximity to the blow hole to the edge on the basis of the output of the jet flow sensing means and the output of the jet length sensing means;

detecting a fingering state based on operated states of the tone keys;

designating an audio frequency realizing a desired note and a desired octave based on the fingering state;

calculating a jet angle by way of a multiplication using the audio frequency and the jet transmission time; and controlling the tone generator in terms of an amplitude and a tone pitch of a musical tone signal based on the output of the jet flow sensing means, wherein the musical tone signal is controlled so as to be increased in tone pitch by one octave when the jet angle belongs to a first range, and the musical tone signal is controlled so as to be decreased in tone pitch by one octave when the jet angle belongs to a second range higher than the first range during generation of the musical tone signal whose tone pitch is once increased by one octave.

3. A tone control device adapted to an electronic wind instrument having a tube, a lip plate having a blow hole, a plurality of tone keys, and a tone generator, said tone control device comprising:

a jet flow sensing means for detecting a velocity or strength of a jet flow, which is caused by blowing air into the blow hole and is transmitted so as to collide with an edge, wherein a jet eccentricity or a jet thickness is detected based on the output of the jet flow sensing means including a plurality of flow sensors vertically arranged with respect to the edge;

a jet length sensing means for detecting a jet length within a range between the lip plate and the edge;

a jet transmission time detection means for detecting a jet transmission time in which a jet travels from a jet outlet in proximity to the blow hole to the edge on the basis of the output of the jet flow sensing means and the output of the jet length sensing means;

a fingering state detection means for detecting a fingering state based on operated states of the tone keys;

an audio frequency designation means for designating an audio frequency realizing a desired note and a desired octave based on the fingering state;

a jet angle calculation means for calculating a jet angle by way of a multiplication using the audio frequency and the jet transmission time; and a tone generator control means for controlling the tone generator in terms of a tone color and/or a tone volume of a musical tone signal based on the output of the jet flow sensing means, wherein the tone generator control means controls the musical tone signal so as to be increased in tone pitch by one octave when the jet angle belongs to a first range, and the tone generator control means controls the musical tone signal so as to be decreased in tone pitch by one octave when the jet angle belongs to a second range higher than the first range during generation of the musical tone signal whose tone pitch is once increased by one octave.

4. The tone control device adapted to an electronic wind instrument according to claim 3, wherein the jet eccentricity is detected with reference to a jet flow distribution curve, which is presumed based on the output of the jet flow sensing means.

5. A computer-readable medium containing a computer program for performing a tone control method adapted to an electronic wind instrument which includes a tube, a lip plate having a blow hole, a plurality of tone keys, and a tone generator, and which is equipped with a jet flow sensing means for detecting a velocity or strength of a jet flow, which is caused by blowing air into the blow hole and is transmitted so as to collide with an edge, so that a jet eccentricity or a jet thickness is detected based on the output of the jet flow sensing means including a plurality of flow sensors vertically arranged with respect to the edge, and a jet length sensing means for detecting a jet length within a range between the lip plate and the edge, said tone control method comprising the steps of:

detecting a jet transmission time in which a jet travels from a jet outlet in proximity to the blow hole to the edge on the basis of the output of the jet flow sensing means and the output of the jet length sensing means;

detecting a fingering state based on operated states of the tone keys;

designating an audio frequency realizing a desired note and a desired octave based on the fingering state;

calculating a jet angle by way of a multiplication using the audio frequency and the jet transmission time; and controlling the tone generator in terms of a tone color and/or a tone volume of a musical tone signal based on the output of the jet flow sensing means, wherein the musical tone signal is controlled so as to be increased in tone pitch by one octave when the jet angle belongs to a first range, and the musical tone signal is controlled so as to be decreased in tone pitch by one octave when the jet angle belongs to a second range higher than the first range during generation of the musical tone signal whose tone pitch is once increased by one octave.

6. The computer-readable medium according to claim 5, wherein the jet eccentricity is detected with reference to a jet flow distribution curve, which is presumed based on the output of the jet flow sensing means.

7. A tone control device adapted to an electronic wind instrument having a tube, a lip plate having a blow hole, a plurality of tone keys, and a tone generator, said tone control device comprising:

a jet flow sensing means for detecting a velocity or strength of a jet flow, which is caused by blowing air into the blow hole and is transmitted so as to collide with an edge;

a jet length sensing means for detecting a jet length within a range between the lip plate and the edge;

a lip contact sensing means for detecting a lip contact value or a lip touch value in connection with the blow hole of the lip plate;

a jet transmission time detection means for detecting a jet transmission time in which a jet travels from a jet outlet in proximity to the blow hole to the edge on the basis of the output of the jet flow sensing means and the output of the jet length sensing means;

a fingering state detection means for detecting a fingering state based on operated states of the tone keys;

an audio frequency designation means for designating an audio frequency realizing a desired note and a desired octave based on the fingering state;

a jet angle calculation means for calculating a jet angle by way of a multiplication using the audio frequency and the jet transmission time; and a tone generator control means for controlling the tone generator in terms of a tone pitch of a musical tone signal based on the output of the jet flow sensing means and the output of the lip contact sensing means, wherein the tone generator control means controls the musical tone signal so as to be increased in tone pitch by one octave when the jet angle belongs to a first range, and the tone generator control means controls the musical tone signal so as to be decreased in tone pitch by one octave when the jet angle belongs to a second range higher than the first range during generation of the musical tone signal whose tone pitch is once increased by one octave.

8. A computer-readable medium containing a computer program for performing a tone control method adapted to an electronic wind instrument which includes a tube, a lip plate having a blow hole, a plurality of tone keys, and a tone generator, and which is equipped with a jet flow sensing means for detecting a velocity or strength of a jet flow, which is caused by blowing air into the blow hole and is transmitted so as to collide with an edge, a jet length sensing means for detecting a jet length within a range between the lip plate and the edge, and a lip contact sensing means for detecting a lip contact value or a lip touch value in connection with the blow hole of the lip plate, said tone control method comprising the steps of:

detecting a jet transmission time in which a jet travels from a jet outlet in proximity to the blow hole to the edge on the basis of the output of the jet flow sensing means and the output of the jet length sensing means;

detecting a fingering state based on operated states of the tone keys;

designating an audio frequency realizing a desired note and a desired octave based on the fingering state;

calculating a jet angle by way of a multiplication using the audio frequency and the jet transmission time; and controlling the tone generator in terms of a tone pitch of a musical tone signal based on the output of the jet flow sensing means and the output of the lip contact sensing means, wherein the musical tone signal is controlled so as to be increased in tone pitch by one octave when the jet angle belongs to a first range, and the musical tone signal is controlled so as to be decreased in tone pitch by one octave when the jet angle belongs to a second range higher than the first range during generation of the musical tone signal whose tone pitch is once increased by one octave.

* * * * *